US010665927B2

(12) United States Patent
Kang et al.

(10) Patent No.: US 10,665,927 B2
(45) Date of Patent: May 26, 2020

(54) ELECTRONIC DEVICE COMPRISING ANTENNA WHICH IS USING AN ELECTRICALLY CONDUCTIVE MATERIAL INCLUDED IN A HOUSING OF THE ELECTRONIC DEVICE

(71) Applicant: Samsung Electronics Co., Ltd., Suwon-si, Gyeonggi-do (KR)

(72) Inventors: Kyung Kyun Kang, Suwon-si (KR); Ji Ho Kim, Anyang-si (KR); Kyung Moon Seol, Yongin-si (KR); Gyu Bok Park, Suwon-si (KR); Hyun Jeong Lee, Suwon-si (KR); Kyi Hyun Jang, Seoul (KR); Hyo Seok Na, Yongin-si (KR); So Young Lee, Gwacheon-si (KR); Jae Bong Chun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 79 days.

(21) Appl. No.: 15/944,116

(22) Filed: Apr. 3, 2018

(65) Prior Publication Data

US 2018/0294548 A1 Oct. 11, 2018

(30) Foreign Application Priority Data

Apr. 10, 2017 (KR) ..... 10-2017-0046244

(51) Int. Cl.
*H01Q 1/24* (2006.01)
*H01Q 9/04* (2006.01)
(Continued)

(52) U.S. Cl.
CPC ..... *H01Q 1/243* (2013.01); *H01Q 1/422* (2013.01); *H01Q 1/48* (2013.01); *H01Q 9/0407* (2013.01); *H01Q 9/0421* (2013.01); *H01Q 5/328* (2015.01)

(58) Field of Classification Search
CPC ..... H01Q 1/243; H01Q 1/422; H01Q 1/48; H01Q 1/44; H01Q 9/0421; H01Q 9/0407; H01Q 5/328; H04M 1/026
See application file for complete search history.

(56) References Cited

U.S. PATENT DOCUMENTS 8,890,766 B2 11/2014 Huynh
9,596,330 B2 * 3/2017 Caballero ..... H01Q 1/243
(Continued)

FOREIGN PATENT DOCUMENTS

CN 205828648 U 12/2016
KR 10-2015-0117161 A 10/2015
(Continued)

*Primary Examiner* — Hoang V Nguyen
*Assistant Examiner* — Awat M Salih
(74) *Attorney, Agent, or Firm* — Jefferson IP Law, LLP

(57) ABSTRACT

An electronic device is provided. The electronic device includes a housing comprising a first plate, a second plate, and a side member surrounding a space between the first and second plates, a wireless communication circuit that feeds a first feeding point in the second plate, a ground plane electrically coupled to a first ground point and a second ground point in the second plate, and a processor. The side member includes a first side, a second side, a third side, and a fourth side. The first feeding point is between the second side and the first ground point, the first feeding point being closer to the second side than the first ground point is to the second side, and the second ground point being closer to the second side than the first feeding point and the first ground point is to the second side, and is outside the region.

20 Claims, 16 Drawing Sheets

(51) Int. Cl.

| | |
|---|---|
| ***H01Q 1/48*** | (2006.01) |
| ***H01Q 1/42*** | (2006.01) |
| *H01Q 5/328* | (2015.01) |

(56) References Cited

U.S. PATENT DOCUMENTS

| | | | | |
|---|---|---|---|---|
| 9,608,312 | B2 | 3/2017 | Gu et al. | |
| 9,755,298 | B2 | 9/2017 | Choi et al. | |
| 2011/0187611 | A1 | 8/2011 | Von Arbin et al. | |
| 2011/0254741 | A1 | 10/2011 | Ishimiya | |
| 2012/0299785 | A1* | 11/2012 | Bevelacqua | H01Q 9/42 343/702 |
| 2013/0141303 | A1 | 6/2013 | Huynh | |
| 2014/0139379 | A1* | 5/2014 | Bolin | H01Q 9/06 343/702 |
| 2016/0064804 | A1 | 3/2016 | Kim et al. | |
| 2016/0079652 | A1 | 3/2016 | Gu et al. | |
| 2016/0079655 | A1 | 3/2016 | Gu et al. | |
| 2016/0088131 | A1 | 3/2016 | Chiu | |
| 2016/0197396 | A1 | 7/2016 | Choi et al. | |
| 2016/0285153 | A1 | 9/2016 | Li et al. | |
| 2017/0033437 | A1 | 2/2017 | Ghit et al. | |
| 2018/0069306 | A1 | 3/2018 | Xue et al. | |

FOREIGN PATENT DOCUMENTS

| | | | |
|---|---|---|---|
| KR | 10-2016-0026581 | A | 3/2016 |
| KR | 10-2016-0084192 | A | 7/2016 |
| WO | 2016/154851 | A1 | 10/2016 |

* cited by examiner (a)

(b)

320

ELECTRONIC DEVICE COMPRISING ANTENNA WHICH IS USING AN ELECTRICALLY CONDUCTIVE MATERIAL INCLUDED IN A HOUSING OF THE ELECTRONIC DEVICE

CROSS-REFERENCE TO RELATED APPLICATION(S)

This application is based on and claims priority under 35 U.S.C. § 119(a) of a Korean patent application number 10-2017-0046244, filed on Apr. 10, 2017, in the Korean Intellectual Property Office, the disclosure of which is incorporated by reference herein its entirety.

TECHNICAL FIELD

The disclosure relates to an antenna technology for utilizing a metal housing included in an electronic device.

BACKGROUND

An electronic device such as a smailphone, a tablet, or the like may communicate with a network by using an antenna. Nowadays, the electronic device is using a metal material in a housing for the purpose of increasing strength (or rigidity) and improving a design. For example, the electronic device may use a portion of a metal housing as an antenna.

The above information is presented as background information only to assist with an understanding of the disclosure. No determination has been made, and no assertion is made, as to whether any of the above might be applicable as prior art with regard to the disclosure.

SUMMARY

To use the metal housing as an antenna, a feeding point and a ground point may be additionally implemented in the metal housing. Besides, a secondary process for deforming the housing may be required to implement a radiation structure. In the case where the secondary process is performed, the mechanical strength of the metal housing may become weak or an assemble structure may become complicated. Also, there is a limitation on a design in that a slit is formed in the metal housing or metal in a partial region of the housing is removed.

Aspects of the disclosure are to address at least the above-mentioned problems and/or disadvantages and to provide at least the advantages described below. Accordingly, an aspect of the disclosure is to provide a method of using an original shape of a metal housing without any other process except for implementing a feeding point and a ground point in the metal housing.

In accordance with an aspect of the disclosure, an electronic device is provided. The electronic device includes a housing comprising a first plate, a second plate facing away from the first plate, and a side member surrounding a space between the first plate and the second plate, the second plate being formed of an electrically conductive material, the side member being formed of an electrically conductive material and including a first side extending in a first direction and having a first length, a second side extending in a second direction perpendicular to the first direction and having a second length shorter than the first length, a third side extending in parallel to the first side and having the first length, and a fourth side extending in parallel to the second side and having the second length, the side member further including an elongated slit extending from a first point in the first side to a second point in the third side along a portion of the first side, the second side, and a portion of the third side, and a non-conductive material filling the slit, a touch-screen display exposed through at least a portion of the first plate, a wireless communication circuit that is positioned inside the housing and is electrically coupled to a third point and a fourth point in the second plate, the third point being closer to the second side than the fourth point is to the second side, a ground plane positioned in the housing in parallel to the second plate, and electrically coupled to at least one fifth point and a sixth point in the second plate, the sixth point being closer to the second side than the fourth point and the at least one fifth point are to the second side, the third point being closer to the second side than the sixth point is to the second side, and the fourth point being closer to the second side than the at least one fifth point is to the second side, and at least one processor positioned inside the housing and electrically connected to the display and the communication circuit.

In accordance with another aspect of the disclosure, an electronic device is provided. The electronic device includes a housing that includes a first plate, a second plate facing away from the first plate and including an electrically conductive material, and a side member surrounding a space between the first plate and the second plate, a display that is exposed through at least a portion of the first plate, a wireless communication circuit that feeds a first feeding point in the second plate, a ground plane that is electrically coupled to at least one first ground point in a first region of the second plate and a second ground point in a second region of the second plate, and at least one processor that is electrically connected to the display and the wireless communication circuit. The wireless communication circuit, the ground plane, and the at least one processor is positioned inside the housing. The side member is formed of an electrically conductive material. The side member includes a first side extending in a first direction and having a first length, a second side extending in a second direction perpendicular to the first direction and having a second length shorter than the first length, a third side extending in parallel to the first side and having the first length, and a fourth side extending in parallel to the second side and having the second length. The first feeding point is in a region between the second side and the at least one first ground point. The first feeding point is closer to the second side than the at least one first ground point is to the second side. The second ground point is closer in distance to the second side than the first feeding point and the at least one first ground point is to the second side, and is outside the region.

According to embodiments, it may be possible to reduce a mechanical limitation by using an original shape of a metal housing as an antenna and to improve aesthetics of an electronic device.

According to embodiments, the electronic device may transmit and receive signals in various frequency bands by using a plurality of feeding points and a plurality of ground points.

Besides, a variety of effects directly or indirectly understood through this disclosure may be provided.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1A:
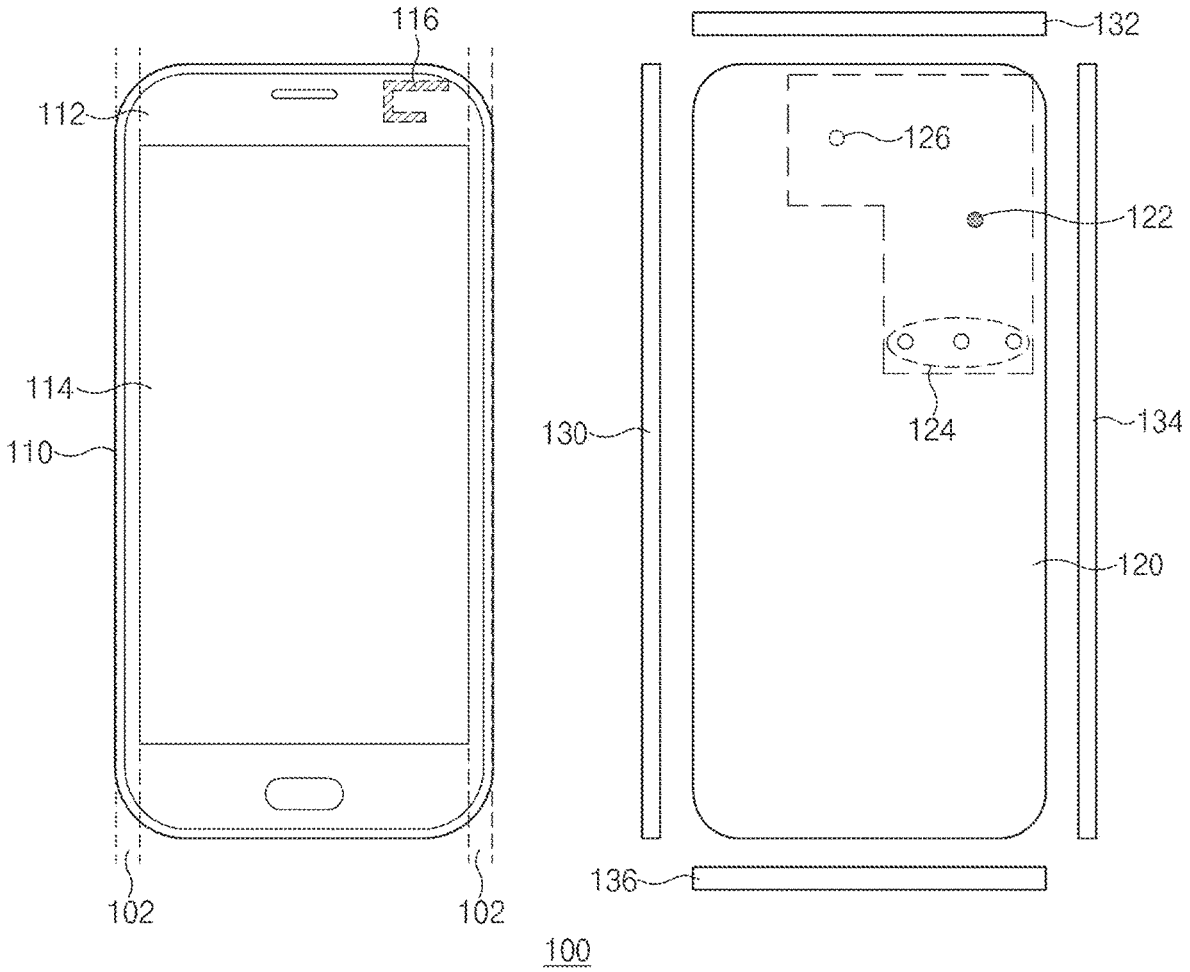
FIG. 1A is a view illustrating an electronic device according to an embodiment of the disclosure.

The following description with reference to accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In this disclosure, the expressions "have," "may have," "include" and "comprise," or "may include" and "may comprise" used herein indicate existence of corresponding features (e.g., elements such as numeric values, functions, operations, or components) but do not exclude presence of additional features.

In this disclosure, the expressions "A or B," "at least one of A or/and B," or "one or more of A or/and B," and the like may include any and all combinations of one or more of the associated listed items. For example, the term "A or B," "at least one of A and B," or "at least one of A or B" may refer to all of the case (1) where at least one A is included, the case (2) where at least one B is included, or the case (3) where both of at least one A and at least one B are included.

The terms, such as "first," "second," and the like used in this disclosure may be used to refer to various elements regardless of the order and/or the priority and to distinguish the relevant elements from other elements, but do not limit the elements. For example, "a first user device" and "a second user device" indicate different user devices regardless of the order or priority. For example, without departing the scope of the disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

According to the situation, the expression "configured to" used in this disclosure may be used as, for example, the expression "suitable for," "having the capacity to," "designed to," "adapted to," "made to," or "capable of" The term "configured to" must not mean only "specifically designed to" in hardware. Instead, the expression "a device configured to" may mean that the device is "capable of" operating together with another device or other components. For example, a "processor configured to (or set to) perform A, B, and C" may mean a dedicated processor (e.g., an embedded processor) for performing a corresponding operation or a generic-purpose processor (e.g., a central processing unit (CPU) or an application processor (AP)) which performs corresponding operations by executing one or more software programs which are stored in a memory device.

Terms used in this disclosure are used to describe specified embodiments and are not intended to limit the scope of the disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal unless expressly so defined in various embodiments of this disclosure. In some cases, even if terms are terms which are defined in this disclosure, they may not be interpreted to exclude embodiments of this disclosure.

An electronic device according to various embodiments of this disclosure may include at least one of, for example, smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) audio layer 3 (MP3) players, mobile medical devices, cameras, or wearable devices. According to various embodiments, the wearable device may include at least one of an accessory type (e.g., watches, rings, bracelets, anklets, necklaces, glasses, contact lens, or head-mounted-devices (HMDs), a fabric or garment-integrated type (e.g., an electronic apparel), a body-attached type (e.g., a skin pad or tattoos), or a bio-implantable type (e.g., an implantable circuit).

According to various embodiments, the electronic device may be a home appliance. The home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or PlayStation™), electronic dictionaries, electronic keys, camcorders, electronic picture frames, and the like.

According to another embodiment, an electronic device may include at least one of various medical devices (e.g., various portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation devices, Global Navigation Satellite System (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), points of sales (POSs) of stores, or internet of things (e.g., light bulbs, various sensors, electric or gas meters, sprinkler devices, fire alarms, thermostats, street lamps, toasters, exercise equipment, hot water tanks, heaters, boilers, and the like).

According to an embodiment, the electronic device may include at least one of parts of furniture or buildings/structures, electronic boards, electronic signature receiving devices, projectors, or various measuring instruments (e.g., water meters, electricity meters, gas meters, or wave meters, and the like). According to various embodiments, the electronic device may be one of the above-described devices or a combination thereof. An electronic device according to an embodiment may be a flexible electronic device. Furthermore, an electronic device according to an embodiment of this disclosure may not be limited to the above-described electronic devices and may include other electronic devices and new electronic devices according to the development of technologies.

Hereinafter, electronic devices according to various embodiments will be described with reference to the accompanying drawings. In this disclosure, the term "user" may refer to a person who uses an electronic device or may refer to a device (e.g., an artificial intelligence electronic device) that uses the electronic device.

Figure 1B:
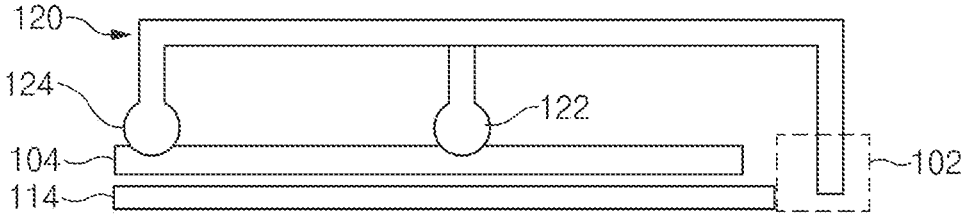
FIG. 1B illustrates a structure of an antenna according to an embodiment of the disclosure.

FIG. 1A is a view illustrating an electronic device according to an embodiment of the disclosure, and FIG. 1B illustrates a structure of an antenna according to an embodiment of the disclosure.

Referring to FIGS. 1A and 1B, an electronic device 100 according to an embodiment may be surrounded by a housing. For example, the housing of the electronic device 100 may include a first plate 110, a second plate 120 facing away from the first plate 110 and including an electrically conductive material, and a side member (130, 132, 134, 136) surrounding a space between the first plate 110 and the second plate 120.

The first plate 110 may include a display 114 exposed through at least a portion of the first plate 110. The first plate 110 may be, for example, a front surface of the electronic device 100.

According to an embodiment, at least a portion of the second plate 120 may include an electrically conductive material. The second plate 120 may be, for example, a rear surface of the electronic device 100. The second plate 120 may be, for example, at least a portion of a metal housing.

According to an embodiment, at least a portion of the side member may include an electrically conductive material. The side member may be, for example, at least a portion of the metal housing. For example, the side member may include a first side 130, a second side 132, a third side 134, and a fourth side 136. The first side 130 may extend in a first direction and may have a first length. The second side 132 may extend in a second direction perpendicular to the first direction and may have a second length shorter than the first length. The third side 134 may extend in parallel to the first side 130 and may have the first length. The fourth side 136 may extend in parallel to the second side 132 and may have the second length.

According to an embodiment, at least one point in the second plate 120 may be electrically coupled to a printed circuit board in the electronic device 100. For example, a first feeding point 122 may be electrically coupled to a wireless communication circuit, and at least one first ground point 124 and at least one second ground point 126 may be electrically coupled to a ground plane. The case where the number of the at least one second ground point 126 is "1" if the number of at least one first ground point 124 is "3" is illustrated in FIG. 1A as an exemplification. However, the disclosure may not be limited thereto. For example, each of the at least one first ground point 124 and the at least one second ground point 126 may include one ground point or two or more ground points.

In an embodiment, a resonance frequency may vary with a distance between the first feeding point 122 and the at least one first ground point 124 or with a distance between the first feeding point 122 and the second side 132.

In an embodiment, the wireless communication circuit may be configured to feed the first feeding point 122 in the second plate 120. The second plate 120 may be fed in a direct feeding manner or in an indirect feeding manner.

In an embodiment, the ground plane may be electrically coupled to the at least one first ground point 124 in a first region of the second plate 120 and the at least one second ground point 126 in a second region of the second plate 120.

In an embodiment, the wireless communication circuit and the ground plane may be coupled to the second plate 120 through a connection member (e.g., a C-clip, a metal extension part, a screw, or a spring) extending from an antenna element. In an embodiment, the first feeding point 122 may be closer to the second side 132 than the at least one first ground point 124 (or than the at least one first ground point 124 is to the second side 132) and may be in a region between the second side 132 and the at least one first ground point 124. The at least one second ground point 126 may be closer in distance to the second side 132 than the first feeding point 122 and the at least one first ground point 124, and may be outside the region.

According to an embodiment, if an electrical signal is provided to the first feeding point 122 in the second plate 120, a partial region of the second plate 120 may operate as an antenna. For example, a partial region of the second plate 120, which is specified by locations of the first feeding point 122, the at least one first ground point 124, and the at least one second ground point 126, may operate as an antenna.

In an embodiment, the display 114 of the front surface of the electronic device 100 and the second plate 120 may operate as an antenna of a planar inverted F antenna (PIFA) type. For example, referring to FIG. 1B, the electronic device 100 may feed the first feeding point 122 in the second plate 120, and the second plate 120 may be connected with a ground region of a printed circuit board 104 at the at least one first ground point 124. If power is supplied to the first feeding point 122, the second plate 120 may operate as an antenna of the PIFA type.

In an embodiment, spaces 102 of a given width may exist between the side member and the display 114. For example, the spaces 102 of the given width may be a slot or a black matrix (BM). An electrical signal of an antenna may be radiated through the spaces 102. In an embodiment, the spaces 102 may function as an opening through which the antenna radiates an electrical signal. A housing antenna of FIG. 1A according to an embodiment may radiate an electrical signal mainly through the space 102 of the left side.

In another embodiment, the wireless communication circuit of the electronic device 100 may be configured to feed a third feeding point in any region 112 of the first plate 110 other than the display 114. A conductive member 116 may be electrically coupled to the third feeding point. Even though a separate antenna for wireless fidelity (Wi-Fi), Bluetooth (BT), or global positioning system (GPS) is mounted in the first plate 110, it may be possible to operate the antenna included in the second plate 120.

Figure 2:
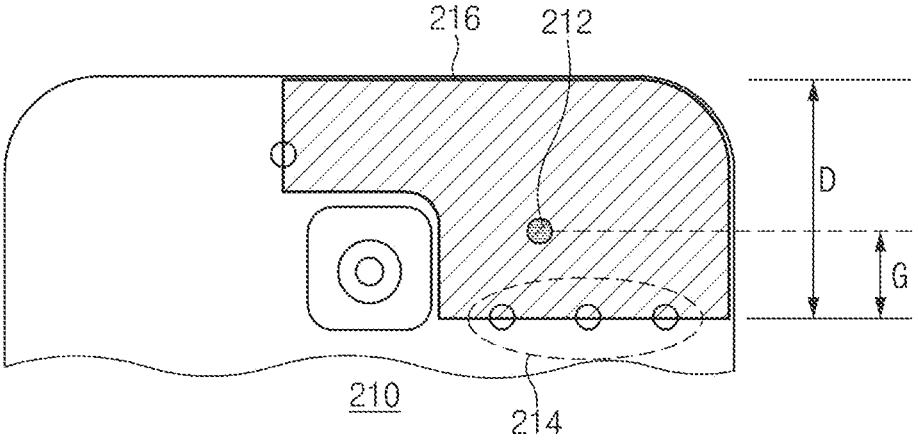
FIG. 2 is a view for describing how a feeding point and a ground point are selected in a second plate, according to an embodiment of the disclosure.

FIG. 2 is a view for describing how a feeding point and a ground point are selected in a second plate, according to an embodiment of the disclosure.

Referring to FIG. 2, a resonance frequency of an antenna included in a second plate 210 (e.g., the second plate 120 of FIGS. 1A and 1B) may vary with locations of a feeding point and a ground point. For example, in the case where a distance from a second side 216 to at least one first ground point 214 is "D" and a distance from a first feeding point 212 to the at least one first ground point 214 is "G," the electronic device 100 may transmit and receive a wireless signal of a frequency, which varies with the distances "G" and "D."

According to an embodiment, the second plate 210 may transmit and receive a signal of a frequency, which is differently determined depending on a location relationship of the second side 216, a feeding point, and a ground point.

In an embodiment, the at least one first ground point 214 may be at a point that is spaced apart from the second side 216 by a distance of "λ/4." Here, "i" may be, as an example, a wavelength of a signal. The first feeding point 212 may be at a point that is spaced apart from the at least one first ground point 214 by a distance of "λ/10." For example, locations of the at least one first ground point 214 and the first feeding point 212 may be determined in consideration of influence between the metal housing and a printed circuit board or any other part (or component) in the electronic device 100.

| | Recommended | Optimal result value for each main band | |
|---|---|---|---|
| Parameter | value | GPS (1.575 GHz) | Wi-Fi (2.4 GHz) |
| D | λ/4 | 51 mm | 23 mm |
| G | λ/10 | 14 mm | 10 mm |

Referring to the above table, in one experimental example, if a value of "D" is set to 51 mm and a value of "G" is set to 14 mm, the antenna included in the second plate 210 may transmit and receive a signal of 1.575 GHz. For example, the antenna included in the second plate 210 may operate as a GPS antenna. In another experimental example, if a value of "D" is set to 23 mm and a value of "G" is set to 10 mm, the antenna included in the second plate 210 may transmit and receive a signal of 2.4 GHz. For example, the antenna included in the second plate 210 may operate as a Wi-Fi antenna or a BT antenna. The antenna may be configured to transmit and receive a signal in a frequency range from 1.5 GHz to 2.4 GHz.

Figure 3:
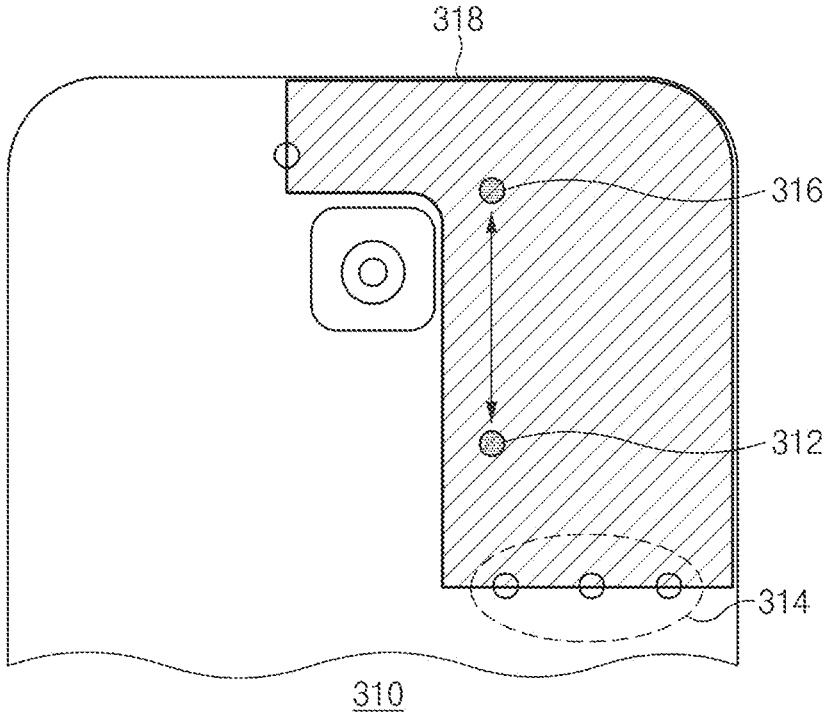
FIG. 3 is a view for describing an operation of an antenna in the case where a second plate includes multiple feeding points, according to an embodiment of the disclosure.
Figure 3:
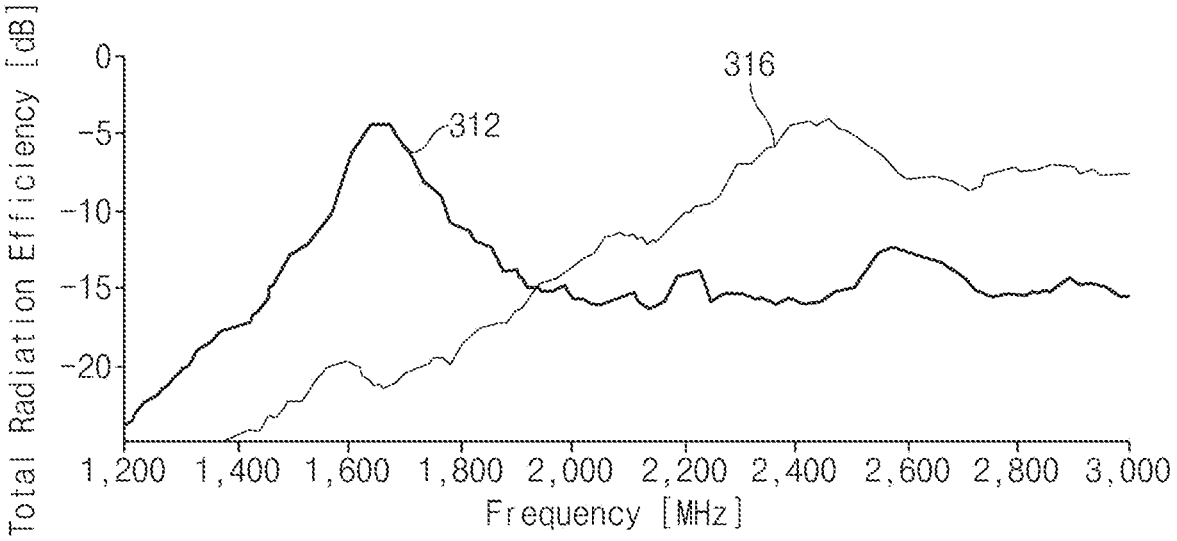

FIG. 3 is a view for describing an operation of an antenna in the case where a second plate includes multiple feeding points, according to an embodiment of the disclosure.

According to various embodiments, a second plate 310 (e.g., the second plate 120 of FIGS. 1A and 1B) of an electronic device (e.g., the electronic device 100 of FIGS. 1A and 1B) may include multiple feeding points.

In an embodiment, a wireless communication circuit of the electronic device may be configured to feed a second feeding point 316 in the second plate 310. A first feeding point 312 may be in a region between at least one first ground point 314 and the second feeding point 316. In an embodiment, the second feeding point 316 may be closer in distance to a second side 318 than the first feeding point 312. The second plate 310 may transmit and receive a higher frequency when power is supplied through the second feeding point 316 than when power is supplied through the first feeding point 312.

Referring to FIG. 3, graph 320 is a graph for describing efficiency of an antenna included in the second plate 310.

Referring to the graph 320, it is understood that a resonance frequency is changed as the first feeding point 312 or the second feeding point 316 is selected as a feeding point. The antenna included in the second plate 310 may operate as an antenna of a multi-band.

In one experimental example, in the case where power is supplied through the first feeding point 312, the antenna included in the second plate 310 may resonate at approximately 1.6 GHz. In this case, the radiation efficiency may be approximately −5 dB. In the case where power is supplied through the second feeding point 316, the antenna included in the second plate 310 may resonate at approximately 2.4 GHz. In this case, the radiation efficiency may be approximately −5 dB. The second plate 310 may operate as a GPS, BT, or Wi-Fi antenna through a multi-feed structure.

Figure 4:
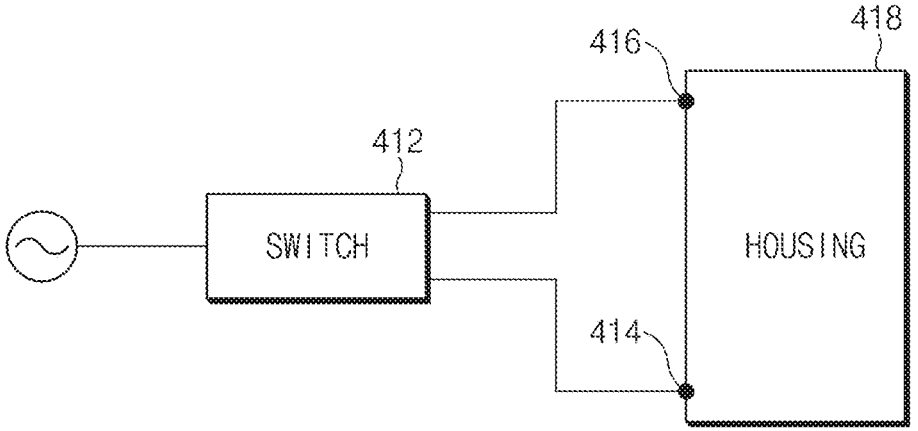
FIG. 4 illustrates a schematic configuration of a switch associated with multiple feeding points of an antenna included in a second plate, according to an embodiment of the disclosure.

FIG. 4 illustrates a schematic configuration of a switch associated with multiple feeding points of an antenna included in a second plate, according to an embodiment of the disclosure.

Referring to FIG. 4, an electronic device (e.g., the electronic device 100 of FIGS. 1A and 1B) may include at least one switch 412. For example, the at least one switch 412 may include a single-pole, double-throw (SP2T) switch, a single-pole, four-throw (SP4T) switch, or a micro electro-mechanical systems (MEMS) switch. For another example, the at least one switch 412 may include a tunable element or a tuner.

According to an embodiment, the electronic device may selectively feed two or more feeding points by using the at least one switch 412. The electronic device may include the at least one switch 412 that is positioned inside a housing 418 and selectively couples a first feeding point 414 and a second feeding point 416. For example, the housing 418 may be the second plate 120 of FIGS. 1A and 1B.

According to various embodiments, the housing 418 may operates as a multi-band antenna by using the at least one switch 412. A feeding point is not limited to the first feeding point 414 and the second feeding point 416. For example, in the case where feeding points capable of transmitting and receiving a signal of a specific frequency are determined, the feeding point may include the determined feeding points. The housing 418 may include three or more feeding points.

In an embodiment, the electronic device may change a feeding location through a switching operation of the at least one switch 412, thus changing a resonance frequency. For example, the housing 418 may operate as a GPS, BT, or Wi-Fi antenna through the switching operation of the at least one switch 412.

Figure 5A:
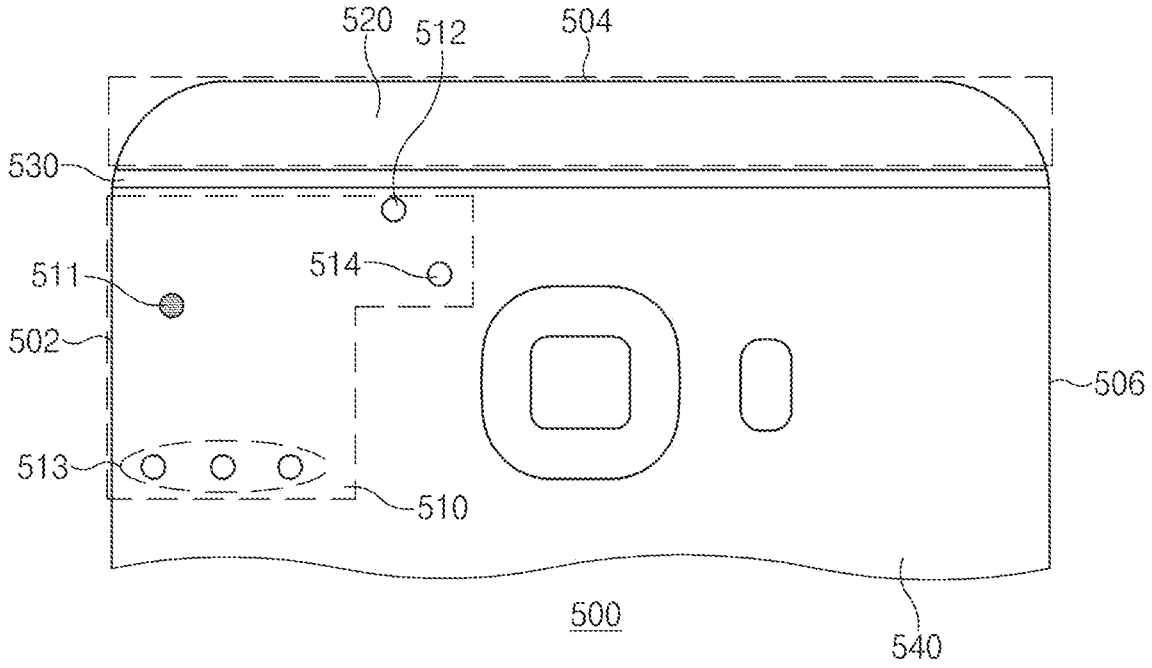
FIGS. 5A, 5B, and 5C are views illustrating an electronic device in the case where a plurality of antenna elements exist in a housing of an electronic device, according to an embodiment of the disclosure.
Figure 5B:
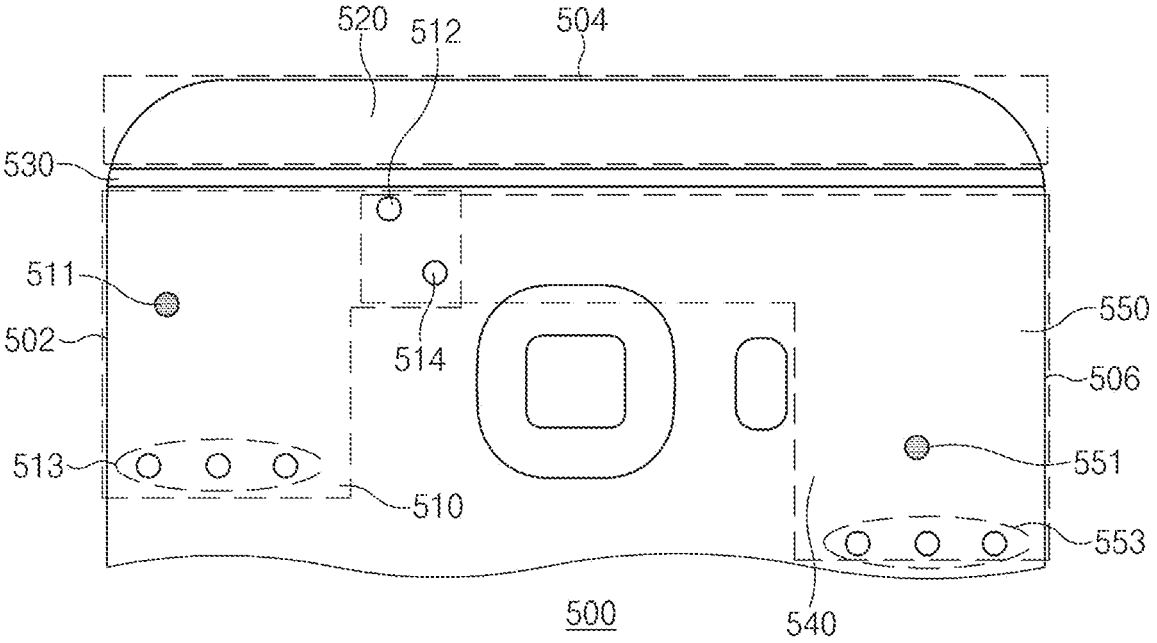
Figure 5C:
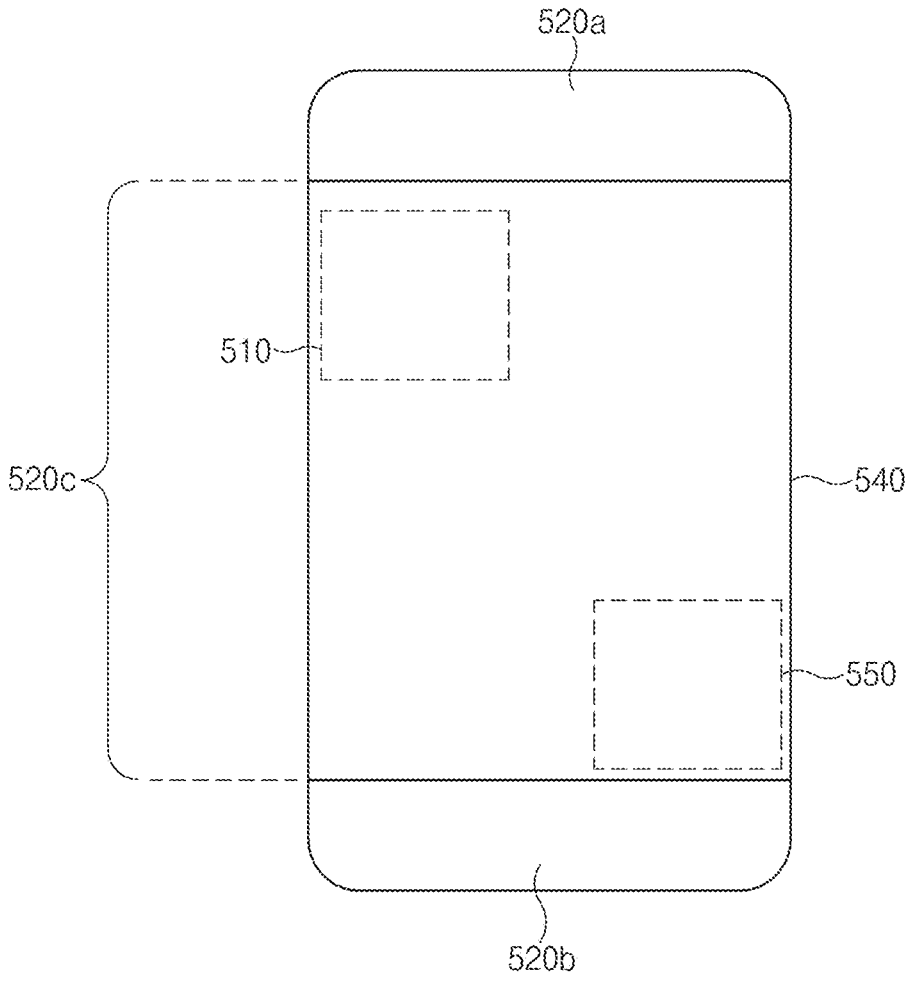

FIGS. 5A to 5C are views illustrating an electronic device in the case where a plurality of antenna elements exists in a housing of an electronic device, according to an embodiment of the disclosure.

Referring to FIG. 5A, a housing 500 of an electronic device (e.g., the electronic device 100 of FIGS. 1A and 1B) according to an embodiment may include a first antenna 510 and a second antenna 520, which are included in a second plate 540 (e.g., the second plate 120 of FIGS. 1A and 1B). The first antenna 510 may be referenced as the antenna described with reference to FIGS. 1A, 1B, 2, and 3. According to an embodiment, the second plate 540 may further include a separate ground point in addition to a second ground point 512 (e.g., the at least one second ground point 126 of FIGS. 1A and 1B).

According to an embodiment, in the case where a plurality of antennas are mounted in the housing 500, an isolation effect may be improved by adding a ground point between the antennas.

In an embodiment, a ground plane in the electronic device may be electrically coupled to a fourth ground point 514 in the second plate 540. The fourth ground point 514 may be near the second ground point 512. The addition of the fourth ground point 514 may make the isolation effect of the first antenna 510 and the second antenna 520 higher.

In an embodiment, a slit 530 may be formed in the housing 500 of the electronic device, and the slit 530 may be filled by a non-conductive material. The slit 530 may be in parallel to an extending line (e.g., a dotted line of a lower end of a second antenna 520 region) and may extend from a point in a first side 502 to a point in a third side 506. The slit 530 may be between a radiator of the second antenna 520 and points of the first antenna 510, which include a first feeding point 511, the second ground point 512, and the fourth ground point 514. The slit 530 may separate the radiator of the second antenna 520 and a radiator of the first antenna 510 together with the second ground point 512 and the fourth ground point 514.

In an embodiment, the radiator of the second antenna 520 may include at least a portion of a side member of a second side 504 of the housing 500, a portion of a side member extending from a point in the first side 502 to the second side 504, a portion of a side member extending from a point in the third side 506 to the second side 504, and a portion of the second plate 540 between the second side 504 and the slit 530. The first feeding point 511, one or more first ground point 513, the second ground point 512, and the fourth ground point 514, which are included in the first antenna 510 in the second plate 540, may be father in distance from the second side 504 than the slit 530.

Referring to FIG. 5B, the housing 500 of the electronic device may include a third antenna 550. For example, the third antenna 550 may include a second feeding point 551 and one or more fifth ground point 553. The third antenna 550 may share a ground point with the first antenna 510. The first antenna 510 and the second antenna 520 may be separated from the third antenna 550 by the shared ground point. For example, the shared ground point may include the second ground point 512 and the fourth ground point 514.

In an embodiment, the second feeding point 551 of the third antenna 550 may be farther from the second side 504 than the first feeding point 511 of the first antenna 510. For example, the third antenna 550 may resonate in a lower frequency band than the first antenna 510.

In another embodiment, the second plate 540 may include the first antenna 510 and the third antenna 550. For example, the second plate 540 of FIG. 5B may include the first antenna 510 and the third antenna 550 except for the second antenna 520. The first antenna 510 and the third antenna 550 may share one or more of the second ground point 512 and the fourth ground point 514 and may transmit and receive signals having different frequencies.

Referring to FIG. 5C, the second plate 540 according to an embodiment may include nonmetal regions 520*a* and 520*b* or a metal region 520*c*. According to an embodiment, the first antenna 510 and the third antenna 550 may be disposed as illustrated in FIG. 5C. For example, the first antenna 510 and the third antenna 550 may be in the metal region 520*c*. For example, the nonmetal regions 510*a* and 510*b* may be formed in the case where a portion of the whole housing region is filled by a dielectric such as plastic. An antenna(s) may be mounted in the nonmetal regions 520*a* and 520*b*.

In an embodiment, the first antenna 510 may include a ground point for improving an isolation effect from an antenna mounted in the nonmetal region 520*a*. The third antenna 550 may include a ground point for improving an isolation effect from an antenna mounted in the nonmetal region 520*b*.

Figure 6:
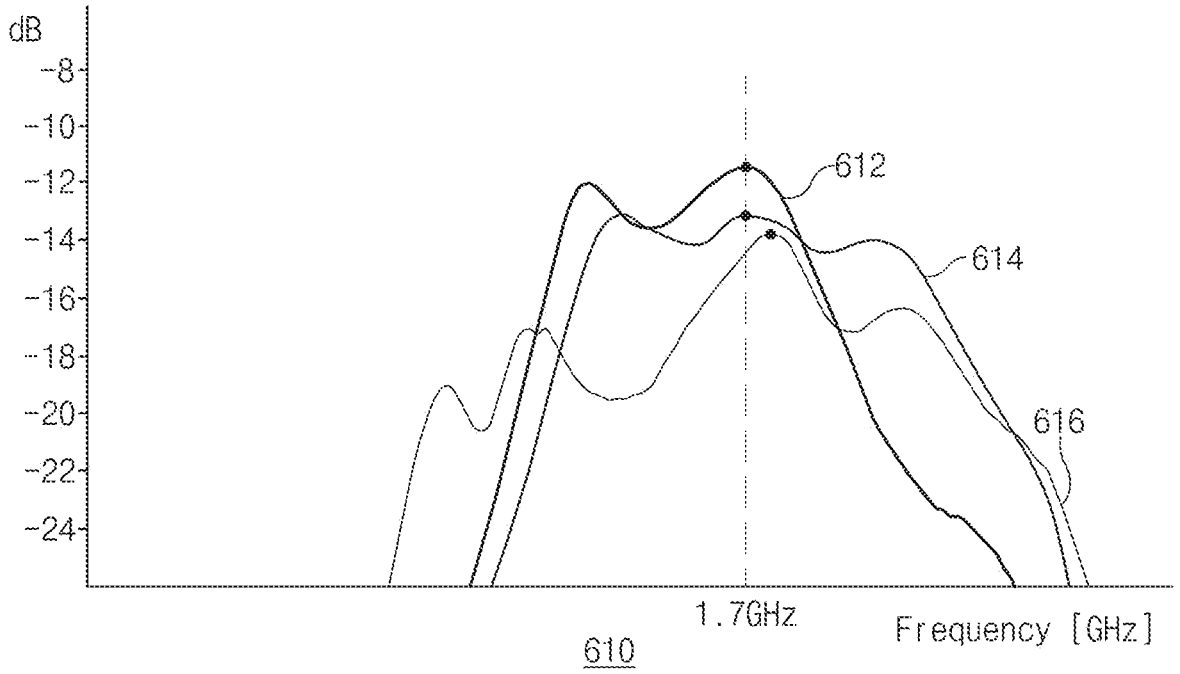
FIG. 6 is a view for describing an isolation improvement effect between different antennas obtained by adding a ground point, according to an embodiment of the disclosure.

FIG. 6 is a view for describing an isolation improvement effect between different antennas obtained by adding a ground point, according to an embodiment of the disclosure.

Referring to FIG. 6, graph 610 shows a result of verifying an isolation effect of the embodiment described with reference to FIGS. 5A to 5C through one experimental example. A description of FIG. 6 will be given by using the reference numerals of FIGS. 5A to 5C.

In one experimental example, the first antenna 510 included in the second plate 540 is a GPS antenna, and the second antenna 520 is a sub-antenna. Isolation between the first antenna 510 and the second antenna 520 is not well made in a band between approximately 1.7 GHz close to 1.575 GHz and approximately 1.8 GHz. Here, 1.575 GHz may be a frequency of a GPS antenna, which belongs to a frequency band of the sub-antenna. In the experimental example, the isolation effect was measured with respect to the band from 1.7 GHz to 1.8 GHz, which isolation is not well made.

The following table shows a result of the graph 610 of FIG. 6. The graph 610 of FIG. 6 indicates a transmission coefficient S21 associated with the frequency of 1.7 GHz.

| Graph classification | S21 peak |
|---|---|
| 612 | −11.5 dB |
| 614 | −13.1 dB |
| 616 | −13.8 dB |

The graph 610 shows a result of measuring the transmission coefficient S21 by comparing case 612 where a ground point is absent from the second plate 540 and case 616 where two ground points are present in the second plate 540. The case 612 may correspond, for example, to the case where both the second ground point 512 and the fourth ground point 514 are absent from the second plate 540. Case 614 may correspond, for example, to the case where only the second ground point 512 is present in the second plate 540. The case 616 may correspond, for example, to the case where both the second ground point 512 and the fourth ground point 514 are present in the second plate 540.

Referring to the graph 610, a peak value of the transmission coefficient S21 was observed as being −11.5 dB in the case 612, −13.1 dB in the case 614, and −13.8 dB in the case 616. It is understood from the above description that the isolation effect between the first antenna 510 and the second antenna 520 is improved by increasing the number of ground points.

Figure 7:
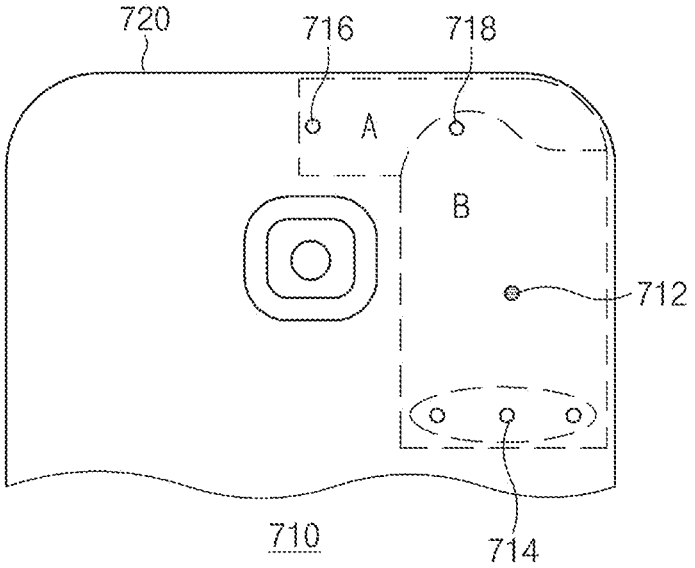
FIG. 7 is a view for describing an operation of an antenna in the case where a second plate includes multiple ground points, according to an embodiment of the disclosure.
Figure 7:
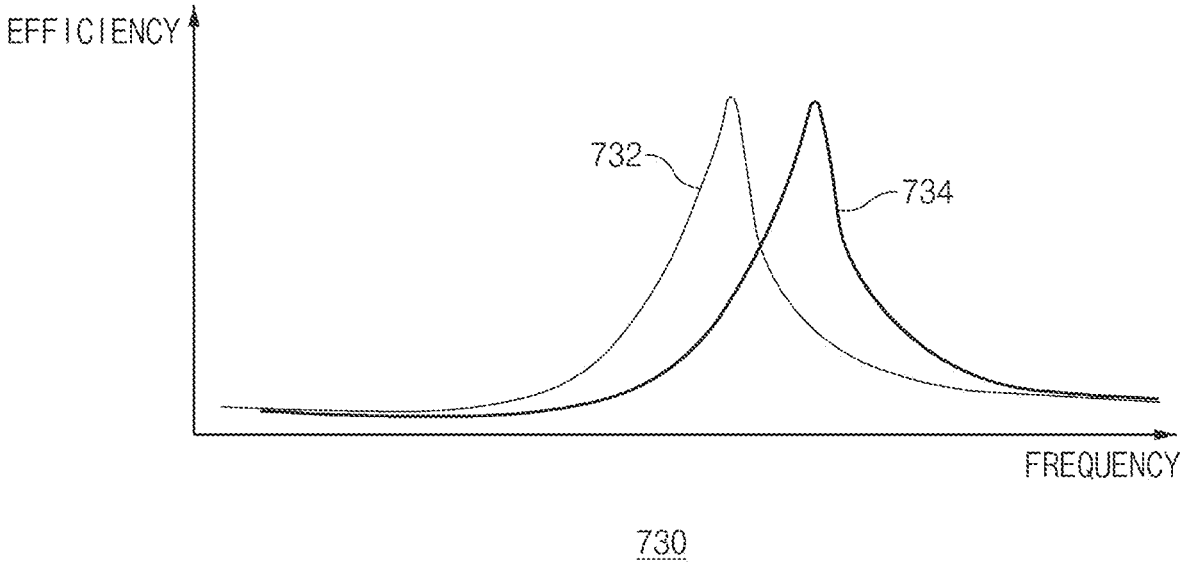

FIG. 7 is a view for describing an operation of an antenna in the case where a second plate includes multiple ground points, according to an embodiment of the disclosure.

Referring to FIG. 7, a second plate 710 (e.g., the second plate 120 of FIGS. 1 A and 1B) of an electronic device (e.g., the electronic device 100 of FIGS. 1 A and 1B) may include multiple ground points. For example, the second plate 710 may include a second ground point 716 and a third ground point 718.

In an embodiment, a ground plane in the electronic device may be electrically coupled to the third ground point 718 in the second plate 710. The third ground point 718 may be closer in distance to a second side 720 than a first feeding point 712 and at least one first ground point 714. Also, the third ground point 718 may be in a region between the second side 720 and the at least one first ground point 714.

In an embodiment, if a ground point is changed from the second ground point 716 to the third ground point 718, a resonance frequency may change. For example, in the case where a ground point is the second ground point 716, a region "A" and a region "B" may operate as a radiator of an antenna. For example, in the case where a ground point is the third ground point 718, the region "B" may operate as a radiator of an antenna. A resonant frequency may be changed as a region of an antenna is changed.

According to an embodiment, a graph 730 is a graph for describing efficiency of an antenna included in the second plate 710 in the case where the second ground point 716 or the third ground point 718 is a ground point. A line 732 indicates a graph corresponding to the case where the second ground point 716 is a ground point, and a line 734 indicates a graph corresponding to the case where the third ground point 718 is a ground point.

Referring to the graph 730, it is understood that a resonance frequency is changed as the second ground point 716 or the third ground point 718 is selected as a ground point.

For example, if a ground point is changed from the second ground point 716 to the third ground point 718, a resonance frequency may become higher. For example, in the case where the second ground point 716 is a ground point, the regions "A" and "B" may be used as an antenna region, and a distance from the first feeding point 712 to the second side 720 are concerned in resonance.

For another example, in the case where the third ground point 718 is a ground point, the region "B" may be used as an antenna region, and a distance from the first feeding point 712 to a boundary line of the region "B" is concerned in resonance. A resonant frequency may become higher as a resonance distance become shorter.

In another embodiment, the electronic device may include a switch that is selectively connected with the second ground point 716 or the third ground point 718. For example, the electronic device may change a resonance frequency through a switching operation of the switch.

Figure 8:
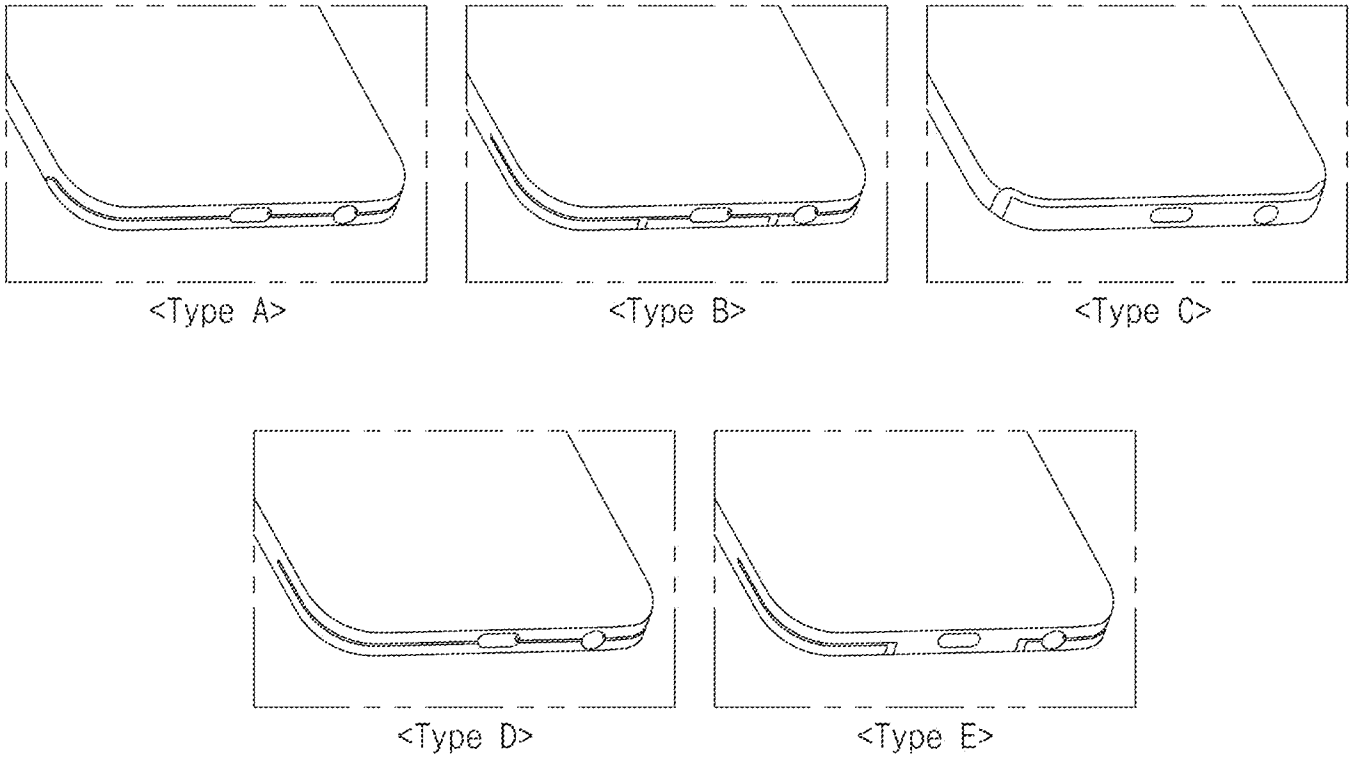
FIG. 8 is a view illustrating structures of slits that are capable of being included in an electronic device, according to various embodiments of the disclosure.

FIG. 8 is a view illustrating structures of slits that are capable of being included in an electronic device, according to various embodiments of the disclosure.

Referring to FIG. 8, a side member of a housing of an electronic device 800 (e.g., the electronic device 100 of FIGS. 1 A and 1B) may include a slit extending along a region of at least one side. A slit included in a side member of a lower end of the electronic device 800 is illustrated in FIG. 8, but a slit may be included in a side member of an upper end of the electronic device.

In an embodiment, a second plate (e.g., the second plate 120 of FIGS. 1 A and 1B) of the housing may be spaced apart from a portion of a side member of the housing by the slit. A plurality of antennas may be formed in the housing.

For example, partial regions or all regions of the plurality of antennas may be spaced apart from each other depending on a shape of the slit. As such, the plurality of antennas may operate as different antennas. Alternatively, the plurality of antennas may operate as a primary antenna element and a secondary antenna element, which are used to transmit the same electrical signal. The plurality of antennas may include a plurality of primary antennas and a plurality of secondary antennas depending on a target frequency. The primary antennas and the secondary antennas may be used to transmit different electrical signals corresponding to respective frequencies.

In an embodiment, in the case where the performance of radiation of one antenna element of the plurality of antenna elements is reduced by any other antenna element, the one antenna element and the other antenna element may be electrically coupled to each other, thereby improving the performance of radiation of an antenna.

For example, the performance of radiation of an antenna (e.g., the first antenna 510 of FIG. 5A or 5B) included in a second plate may be reduced by any other antenna element. In this case, to improve the performance of radiation, any other antenna element separated by the slit and the antenna (e.g., the first antenna 510 of FIG. 5A or 5B) included in the second plate may be electrically coupled to each other. Since a current is induced in the other antenna element, the overall performance of radiation of the antenna may be improved.

Figure 9:
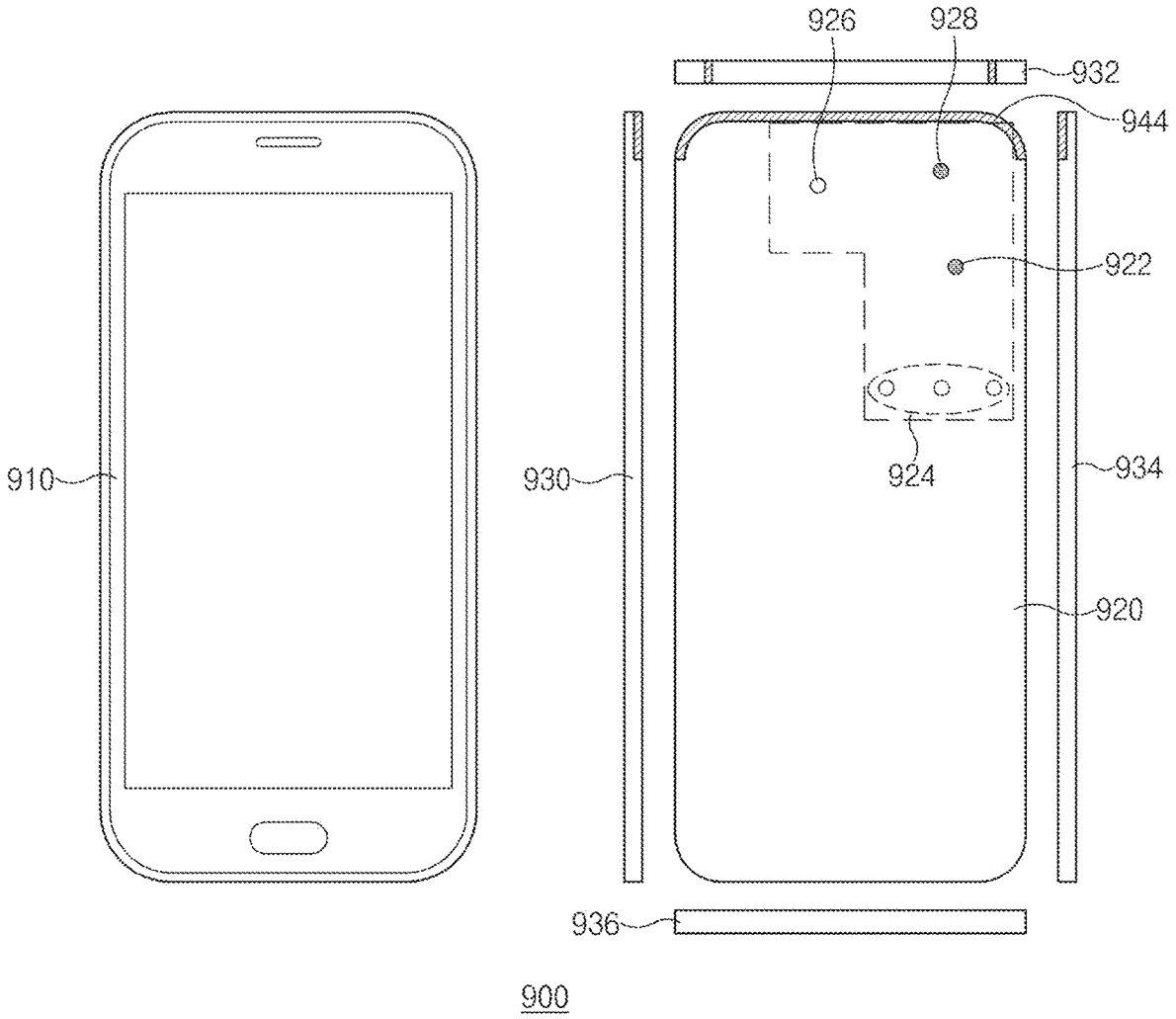
FIG. 9 is a view illustrating an electronic device according to another embodiment of the disclosure.

FIG. 9 is a view illustrating an electronic device according to another embodiment of the disclosure.

Referring to FIG. 9, an electronic device 900 (e.g., the electronic device 100 of FIGS. 1 A and 1B) according to an embodiment may include a housing that includes a first plate 910, a second plate 920 facing away from the first plate 910, a side member surrounding a space between the first plate 910 and the second plate 920.

In an embodiment, at least a portion of the second plate 920 may include an electrically conductive material. The side member may include an electrically conductive material. The side member may include a first side 930 extending in a first direction and having a first length, a second side 932 extending in a second direction perpendicular to the first direction and having a second length shorter than the first length, a third side 934 extending in parallel to the first side 930 and having the first length, and a fourth side 936 extending in parallel to the second side 932 and having the second length.

In an embodiment, the side member of the electronic device 900 may further include an elongated slit 944 extending from a first point in the first side 930 to a second point in the third side 934 along a portion of the first side 930, the second side 932, and a portion of the third side 934, and a non-conductive material filling the elongated slit 944. The elongated slit 944 may make separation of a rear surface and a side surface of the second plate 920 better.

In various embodiments, the elongated slit 944 may be formed in various shapes. For example, the elongated slit 944 may be formed in the slit shape described with reference to FIG. 8.

In an embodiment, the electronic device 900 may include a touchscreen display that is exposed through at least a portion of the first plate 910, and a wireless communication circuit that is positioned inside the housing and is electrically coupled to a third point 928 and a fourth point 922 in the second plate 920.

In an embodiment, the electronic device 900 may include a ground plane that is positioned in the housing in parallel to the second plate 920 and is electrically coupled to at least one fifth point 924 and a sixth point 926 in the second plate 920. The third point 928 may be closer to the second side 932 than the sixth point 926. The sixth point 926 may be closer to the second side 932 than the fourth point 922 and the at least one fifth point 924, the third point 928 may be closer to the second side 932 than the sixth point 926, and the fourth point 922 may be closer to the second side 932 than the at least one fifth point 924.

In an embodiment, the electronic device 900 may include at least one processor that is positioned inside the housing and is electrically connected to the touchscreen display and the wireless communication circuit.

In an embodiment, a partial region of the second plate 920 may operate as a radiator of an antenna that uses the third point 928 and the fourth point 922 as a feeding point and the at least one fifth point 924 and the sixth point 926 as a ground point. The third point 928 or the fourth point 922 may be selectively fed, and thus, the antenna may transmit and receive different frequencies based at least partially on a feeding point.

In an embodiment, the fourth point 922 may be in a region between the third point 928 and the at least one fifth point 924 when viewed from above the second plate 920. The sixth point 926 may be outside the region. An antenna region in the second plate 920 may be specified based on locations of the third point 928 to the sixth point 926.

Figure 10:
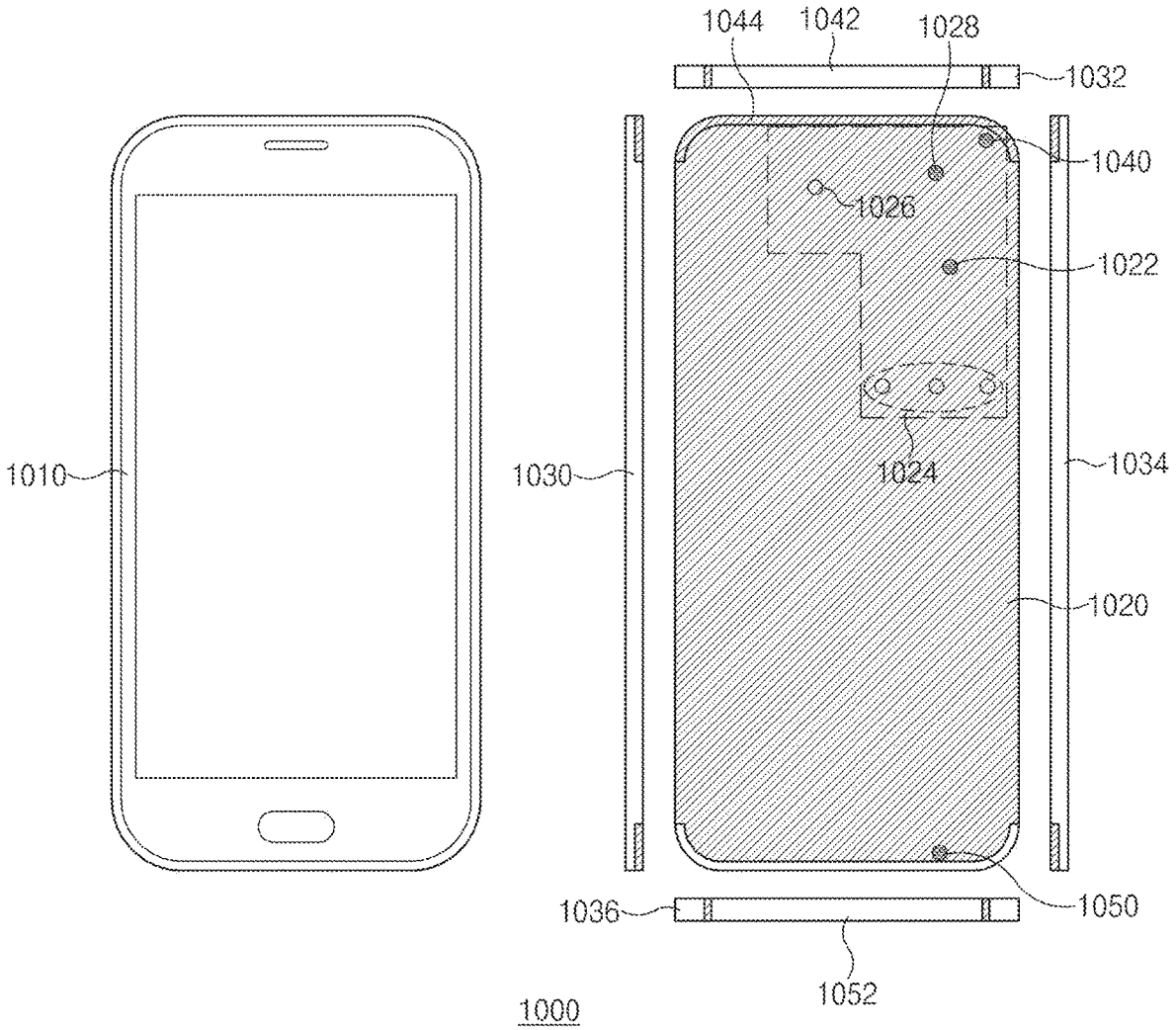
FIG. 10 is a view illustrating an electronic device according to another embodiment of the disclosure.

FIG. 10 is a view illustrating an electronic device according to another embodiment of the disclosure.

Referring to FIG. 10, a housing of an electronic device 1000 (e.g., the electronic device 100 of FIGS. 1 A and 1B) may include a plurality of antenna elements.

In an embodiment, the electronic device 1000 may further include a switching element that is positioned inside the housing and is electrically coupled to a seventh point 1050 near a fourth side 1036. For example, the seventh point 1050 may be a feeding point associated with an antenna 1052. The electronic device 1000 may control feeding the seventh point 1050 through the switching element.

In an embodiment, the housing may include an antenna 1042 extending from a first side 1030 of the housing to a second side 1032 and a third side 1034 or the antenna 1052 extending from the first side 1030 of the housing to the fourth side 1036 and the third side 1034. For example, the antenna 1042 may be a sub-antenna, and the antenna 1052 may be a main antenna.

In an embodiment, an isolation effect of the antenna 1042 and an antenna included in a second plate 1020, which faces away from a first plate 1010, may be improved by a slit 1044.

In an embodiment, the electronic device 1000 may further include a switching element that is positioned inside the housing and is electrically coupled to an eighth point 1040, which is closer to the second side 1032 than a third point 1028. For example, the eighth point 1040 may be a feeding point associated with the antenna 1042. The electronic device 1000 may control feeding the eighth point 1040 through the switching element.

In an embodiment, a fourth point 1022 may be in a region between the eighth point 1040 and at least one fifth point 1024 when viewed from above the second plate 1020. A sixth point 1026 may be outside the region.

Figure 11:
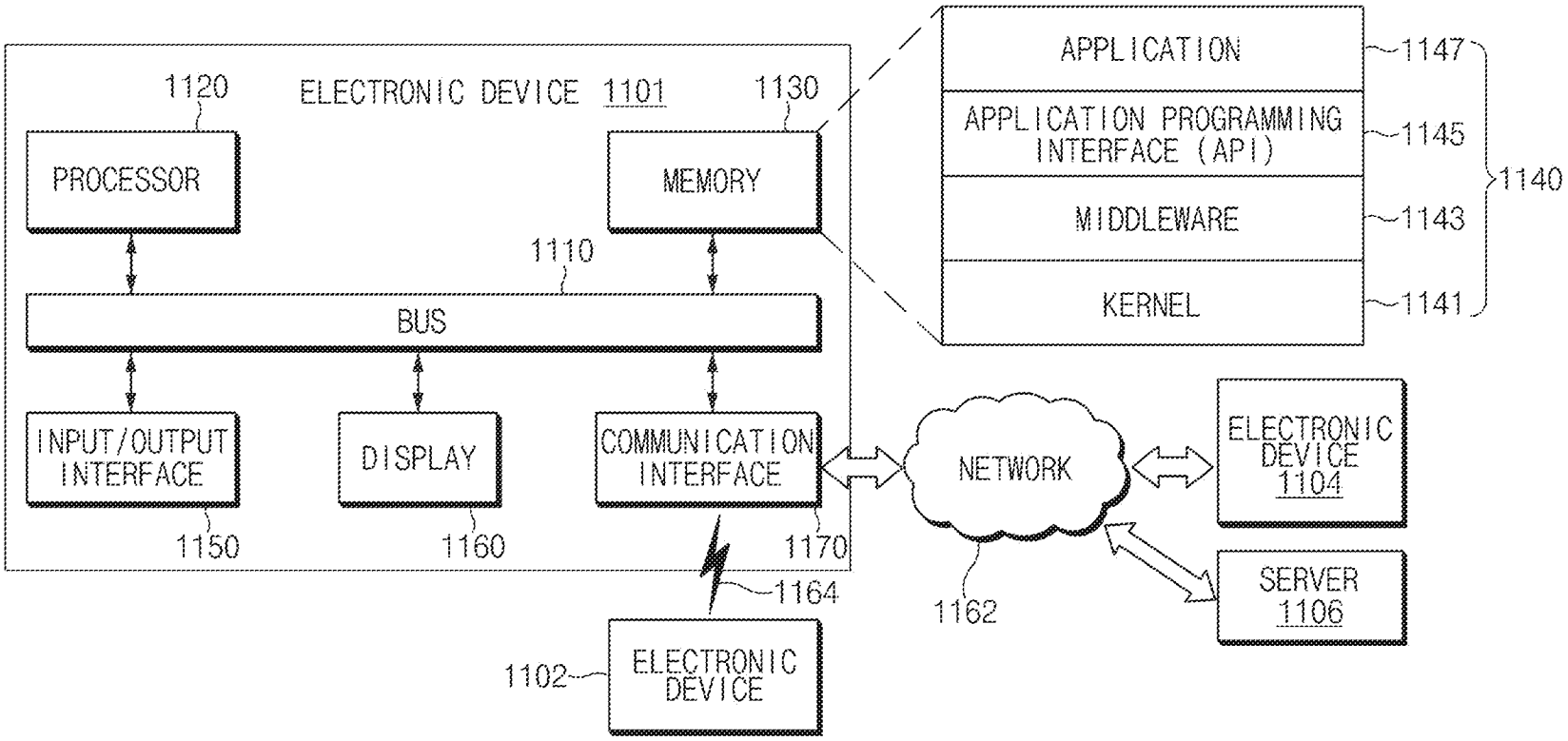
FIG. 11 illustrates an electronic device in a network environment according to various embodiments of the disclosure.

FIG. 11 illustrates an electronic device in a network environment system, according to various embodiments of the disclosure.

Referring to FIG. 11, according to various embodiments, an electronic device 1101, a first electronic device 1102, a second electronic device 1104, or a server 1106 may be connected each other over a network 1162 or a short range communication 1164. The electronic device 1101 may include a bus 1110, a processor 1120, a memory 1130, an input/output interface 1150, a display 1160, and a communication interface 1170. According to an embodiment, the electronic device 1101 may not include at least one of the above-described elements or may further include other element(s).

For example, the bus 1110 may interconnect the processor 1120, the memory 1130, the input/output interface 1150, the display 1160, and the communication interface 1170 and may include a circuit for conveying communications (e.g., a control message and/or data) among the above-described elements.

The processor 1120 may include one or more of a CPU, an AP, or a communication processor (CP). For example, the processor 1120 may perform an arithmetic operation or data processing associated with control and/or communication of at least other elements of the electronic device 1101.

The memory 1130 may include a volatile and/or nonvolatile memory. For example, the memory 1130 may store commands or data associated with at least one other element(s) of the electronic device 1101. According to an embodiment, the memory 1130 may store software and/or a program 1140. The program 1140 may include, for example, a kernel 1141, a middleware 1143, an application programming interface (API) 1145, and/or an application program (or "an application") 1147. At least a part of the kernel 1141, the middleware 1143, or the API 1145 may be referred to as an "operating system (OS)".

For example, the kernel 1141 may control or manage system resources (e.g., the bus 1110, the processor 1120, the memory 1130, and the like) that are used to execute operations or functions of other programs (e.g., the middleware 1143, the API 1145, and the application program 1147). Furthermore, the kernel 1141 may provide an interface that allows the middleware 1143, the API 1145, or the application program 1147 to access discrete elements of the electronic device 1101 so as to control or manage system resources.

The middleware 1143 may perform, for example, a mediation role such that the API 1145 or the application program 1147 communicates with the kernel 1141 to exchange data.

Furthermore, the middleware 1143 may process task requests received from the application program 1147 according to a priority. For example, the middleware 1143 may assign the priority, which makes it possible to use a system resource (e.g., the bus 1110, the processor 1120, the memory 1130, or the like) of the electronic device 1101, to at least one of the application program 1147. For example, the middleware 1143 may process the one or more task requests according to the priority assigned to the at least one, which makes it possible to perform scheduling or load balancing on the one or more task requests.

The API 1145 may be, for example, an interface through which the application program 1147 controls a function provided by the kernel 1141 or the middleware 1143, and may include, for example, at least one interface or function (e.g., an instruction) for a file control, a window control, image processing, a character control, or the like.

The input/output interface 1150 may play a role, for example, of an interface which transmits a command or data input from a user or another external device, to other element(s) of the electronic device 1101. Furthermore, the input/output interface 1150 may output a command or data, received from other element(s) of the electronic device 1101, to a user or another external device.

The display 1160 may include, for example, a liquid crystal display (LCD), a light-emitting diode (LED) display, an organic LED (OLED) display, an MEMS display, or an electronic paper display. The display 1160 may display, for example, various contents (e.g., a text, an image, a video, an icon, a symbol, and the like) to a user. The display 1160 may include a touch screen and may receive, for example, a touch, gesture, proximity, or hovering input using an electronic pen or a part of a user's body.

For example, the communication interface 1170 may establish communication between the electronic device 1101 and an external device (e.g., the first electronic device 1102, the second electronic device 1104, or the server 1106). For example, the communication interface 1170 may be connected to the network 1162 over wireless communication or wired communication to communicate with the external device (e.g., the second electronic device 1104 or the server 1106).

The wireless communication may use at least one of, for example, long-term evolution (LTE), LTE advanced (LTE-A), code division multiple access (CDMA), wideband CDMA (WCDMA), universal mobile telecommunications system (UMTS), wireless broadband (WiBro), global system for mobile communications (GSM), or the like, as cellular communication protocol. Furthermore, the wireless communication may include, for example, the short range communication 1164. The short range communication 1164 may include at least one of Wi-Fi, BT, near field communication (NFC), magnetic stripe transmission (MST), a GNSS, or the like.

The MST may generate a pulse in response to transmission data using an electromagnetic signal, and the pulse may generate a magnetic field signal. The electronic device 1101 may transfer the magnetic field signal to point of sale (POS), and the POS may detect the magnetic field signal using a MST reader. The POS may recover the data by converting the detected magnetic field signal to an electrical signal.

The GNSS may include at least one of, for example, a GPS, a global navigation satellite system (Glonass), a Beidou navigation satellite system (hereinafter referred to as "Beidou"), or an European global satellite-based navigation system (hereinafter referred to as "Galileo") based on an available region, a bandwidth, or the like. Hereinafter, in this disclosure, "GPS" and "GNSS" may be interchangeably used. The wired communication may include at least one of, for example, a universal serial bus (USB), a high definition multimedia interface (HDMI), a recommended standard-232 (RS-232), a plain old telephone service (POTS), or the like. The network 1162 may include at least one of telecommunications networks, for example, a computer network (e.g., local area network (LAN) or wide area network (WAN)), an Internet, or a telephone network.

Each of the first and second electronic devices 1102 and 1104 may be a device of which the type is different from or the same as that of the electronic device 1101. According to an embodiment, the server 1106 may include a group of one or more servers. According to various embodiments, all or a portion of operations that the electronic device 1101 will perform may be executed by another or plural electronic devices (e.g., the first electronic device 1102, the second electronic device 1104 or the server 1106). According to an embodiment, in the case where the electronic device 1101 executes any function or service automatically or in response to a request, the electronic device 1101 may not perform the function or the service internally, but, alternatively additionally, it may request at least a portion of a function associated with the electronic device 1101 from another device (e.g., the first electronic device 1102 or the second electronic device 1104 or the server 1106). The other electronic device may execute the requested function or additional function and may transmit the execution result to the electronic device 1101. The electronic device 1101 may provide the requested function or service using the received result or may additionally process the received result to provide the requested function or service. To this end, for example, cloud computing, distributed computing, or client-server computing may be used.

Figure 12:
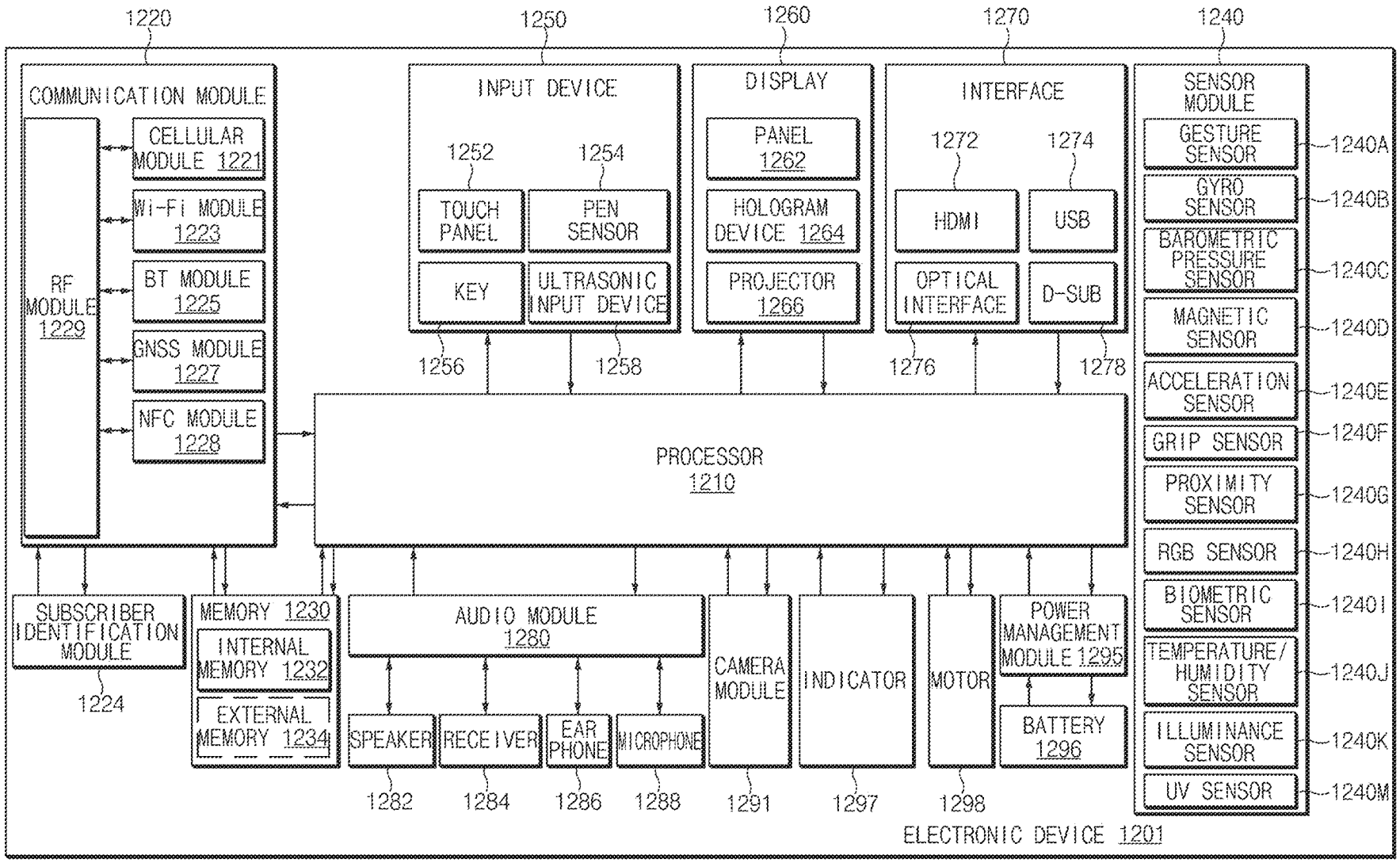
FIG. 12 illustrates a block diagram of an electronic device according to various embodiments of the disclosure.

FIG. 12 illustrates a block diagram of an electronic device, according to various embodiments of the disclosure.

Referring to FIG. 12, an electronic device 1201 may include, for example, all or a part of the electronic device 1101 illustrated in FIG. 11. The electronic device 1201 may include one or more processors (e.g., an AP) 1210, a communication module 1220, a subscriber identification module 1224, a memory 1230, a sensor module 1240, an input device 1250, a display 1260, an interface 1270, an audio module 1280, a camera module 1291, a power management module 1295, a battery 1296, an indicator 1297, and a motor 1298.

The one or more processors 1210 may drive, for example, an OS or an application to control a plurality of hardware or software elements connected to the one or more processors 1210 and may process and compute a variety of data. For example, the one or more processors 1210 may be implemented with a system on chip (SoC). According to an embodiment, the one or more processors 1210 may further include a graphic processing unit (GPU) and/or an image signal processor (ISP). The one or more processors 1210 may include at least a part (e.g., a cellular module 1221) of elements illustrated in FIG. 12. The one or more processors 1210 may load a command or data, which is received from at least one of other elements (e.g., a nonvolatile memory), into a volatile memory and process the loaded command or data. The one or more processors 1210 may store a variety of data in the nonvolatile memory.

The communication module 1220 may be configured the same as or similar to the communication interface 1170 of FIG. 11. The communication module 1220 may include the cellular module 1221, a Wi-Fi module 1223, a BT module 1225, a GNSS module 1227 (e.g., a GPS module, a Glonass module, a Beidou module, or a Galileo module), an NFC module 1228, and a radio frequency (RF) module 1229.

The cellular module 1221 may provide, for example, voice communication, video communication, a character service, an Internet service, or the like over a communication network. According to an embodiment, the cellular module 1221 may perform discrimination and authentication of the electronic device 1201 within a communication network by using the subscriber identification module (e.g., a subscriber identification module (SIM) card) 1224. According to an embodiment, the cellular module 1221 may perform at least a portion of functions that the one or more processors 1210 provides. According to an embodiment, the cellular module 1221 may include a CP.

Each of the Wi-Fi module 1223, the BT module 1225, the GNSS module 1227, or the NFC module 1228 may include a processor for processing data exchanged through a corresponding module, for example. According to an embodiment, at least a part (e.g., two or more) of the cellular module 1221, the Wi-Fi module 1223, the BT module 1225, the GNSS module 1227, or the NFC module 1228 may be included within one integrated circuit (IC) or an IC package.

For example, the RF module 1229 may transmit and receive a communication signal (e.g., an RF signal). For example, the RF module 1229 may include a transceiver, a power amplifier module (PAM), a frequency filter, a low noise amplifier (LNA), an antenna, or the like. According to another embodiment, at least one of the cellular module 1221, the Wi-Fi module 1223, the BT module 1225, the GNSS module 1227, or the NFC module 1228 may transmit and receive an RF signal through a separate RF module.

The subscriber identification module 1224 may include, for example, a card and/or embedded SIM that includes a subscriber identification module and may include unique identify information (e.g., integrated circuit card identifier (ICCID)) or subscriber information (e.g., integrated mobile subscriber identity (IMSI)).

The memory 1230 (e.g., the memory 1130) may include an internal memory 1232 or an external memory 1234. For example, the internal memory 1232 may include at least one of a volatile memory (e.g., a dynamic random access memory (DRAM), a static RAM (SRAM), a synchronous DRAM (SDRAM), or the like), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory), or the like), a hard drive, or a solid state drive (SSD).

The external memory 1234 may further include a flash drive such as compact flash (CF), secure digital (SD), micro-SD), mini-SD), extreme digital (xD), a multimedia card (MMC), a memory stick, or the like. The external memory 1234 may be operatively and/or physically connected to the electronic device 1201 through various interfaces.

The sensor module 1240 may measure, for example, a physical quantity or may detect an operation state of the electronic device 1201. The sensor module 1240 may convert the measured or detected information to an electric signal. For example, the sensor module 1240 may include at least one of a gesture sensor 1240A, a gyro sensor 1240B, a barometric pressure sensor 1240C, a magnetic sensor 1240D, an acceleration sensor 1240E, a grip sensor 1240F, a proximity sensor 1240G, a color sensor 1240H (e.g., red, green, blue (RGB) sensor), a biometric sensor 1240I, a temperature/humidity sensor 1240J, an illuminance sensor 1240K, or a UV sensor 1240M. Although not illustrated, additionally or generally, the sensor module 1240 may further include, for example, an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 1240 may further include a control circuit for controlling at least one or more sensors included therein. According to an embodiment, the electronic device 1201 may further include a processor that is a part of the one or more processors 1210 or independent of the one or more processors 1210 and is configured to control the sensor module 1240. The processor may control the sensor module 1240 while the one or more processors 1210 remains at a sleep state.

The input device 1250 may include, for example, a touch panel 1252, a (digital) pen sensor 1254, a key 1256, or an ultrasonic input unit 1258. For example, the touch panel 1252 may use at least one of capacitive, resistive, IR and ultrasonic detecting methods. Also, the touch panel 1252 may further include a control circuit. The touch panel 1252 may further include a tactile layer to provide a tactile reaction to a user.

The (digital) pen sensor 1254 may be, for example, a part of a touch panel or may include an additional sheet for recognition. The key 1256 may include, for example, a physical button, an optical key, a keypad, or the like. The ultrasonic input device 1258 may detect (or sense) an ultrasonic signal, which is generated from an input device, through a microphone (e.g., a microphone 1288) and may check data corresponding to the detected ultrasonic signal.

The display 1260 (e.g., the display 1160) may include a panel 1262, a hologram device 1264, or a projector 1266. The panel 1262 may be the same as or similar to the display 1160 illustrated in FIG. 11. The panel 1262 may be implemented, for example, to be flexible, transparent or wearable. The panel 1262 and the touch panel 1252 may be integrated into a single module. The hologram device 1264 may display a stereoscopic image in a space using a light interference phenomenon. The projector 1266 may project light onto a screen so as to display an image. For example, the screen may be arranged in the inside or the outside of the electronic device 1201. According to an embodiment, the display 1260 may further include a control circuit for controlling the panel 1262, the hologram device 1264, or the projector 1266.

The interface 1270 may include, for example, an HDMI 1272, a USB 1274, an optical interface 1276, or a D-subminiature (D-sub) 1278. The interface 1270 may be included, for example, in the communication interface 1170 illustrated in FIG. 11. Additionally or generally, the interface 1270 may include, for example, a mobile high definition link (MHL) interface, a SD card/MMC interface, or an infrared data association (IrDA) standard interface.

The audio module 1280 may convert a sound and an electric signal in dual directions. At least a part of the audio module 1280 may be included, for example, in the input/output interface 1150 illustrated in FIG. 11. The audio module 1280 may process, for example, sound information that is input or output through a speaker 1282, a receiver 1284, an earphone 1286, or the microphone 1288.

For example, the camera module 1291 may shoot a still image or a video. According to an embodiment, the camera module 1291 may include at least one or more image sensors (e.g., a front sensor or a rear sensor), a lens, an ISP, or a flash (e.g., an LED or a xenon lamp).

The power management module 1295 may manage, for example, power of the electronic device 1201. According to an embodiment, a power management integrated circuit (PMIC), a charger IC, or a battery or fuel gauge may be included in the power management module 1295. The PMIC may have a wired charging method and/or a wireless charging method. The wireless charging method may include, for example, a magnetic resonance method, a magnetic induction method or an electromagnetic method and may further include an additional circuit, for example, a coil loop, a resonant circuit, or a rectifier, and the like. The battery gauge may measure, for example, a remaining capacity of the battery 1296 and a voltage, current or temperature thereof while the battery is charged. The battery 1296 may include, for example, a rechargeable battery and/or a solar battery.

The indicator 1297 may display a specific state of the electronic device 1201 or a part thereof (e.g., the one or more processors 1210), such as a booting state, a message state, a charging state, and the like. The motor 1298 may convert an electrical signal into a mechanical vibration and may generate the following effects: vibration, haptic, and the like. Although not illustrated, a processing device (e.g., a GPU) for supporting a mobile TV may be included in the electronic device 1201. The processing device for supporting the mobile TV may process media data according to the standards of digital multimedia broadcasting (DMB), digital video broadcasting (DVB), MediaFlo™, or the like.

Each of the above-mentioned elements of the electronic device according to various embodiments of the disclosure may be configured with one or more components, and the names of the elements may be changed according to the type of the electronic device. In various embodiments, the electronic device may include at least one of the above-mentioned elements, and some elements may be omitted or other additional elements may be added. Furthermore, some of the elements of the electronic device according to various embodiments may be combined with each other so as to form one entity, so that the functions of the elements may be performed in the same manner as before the combination.

Figure 13:
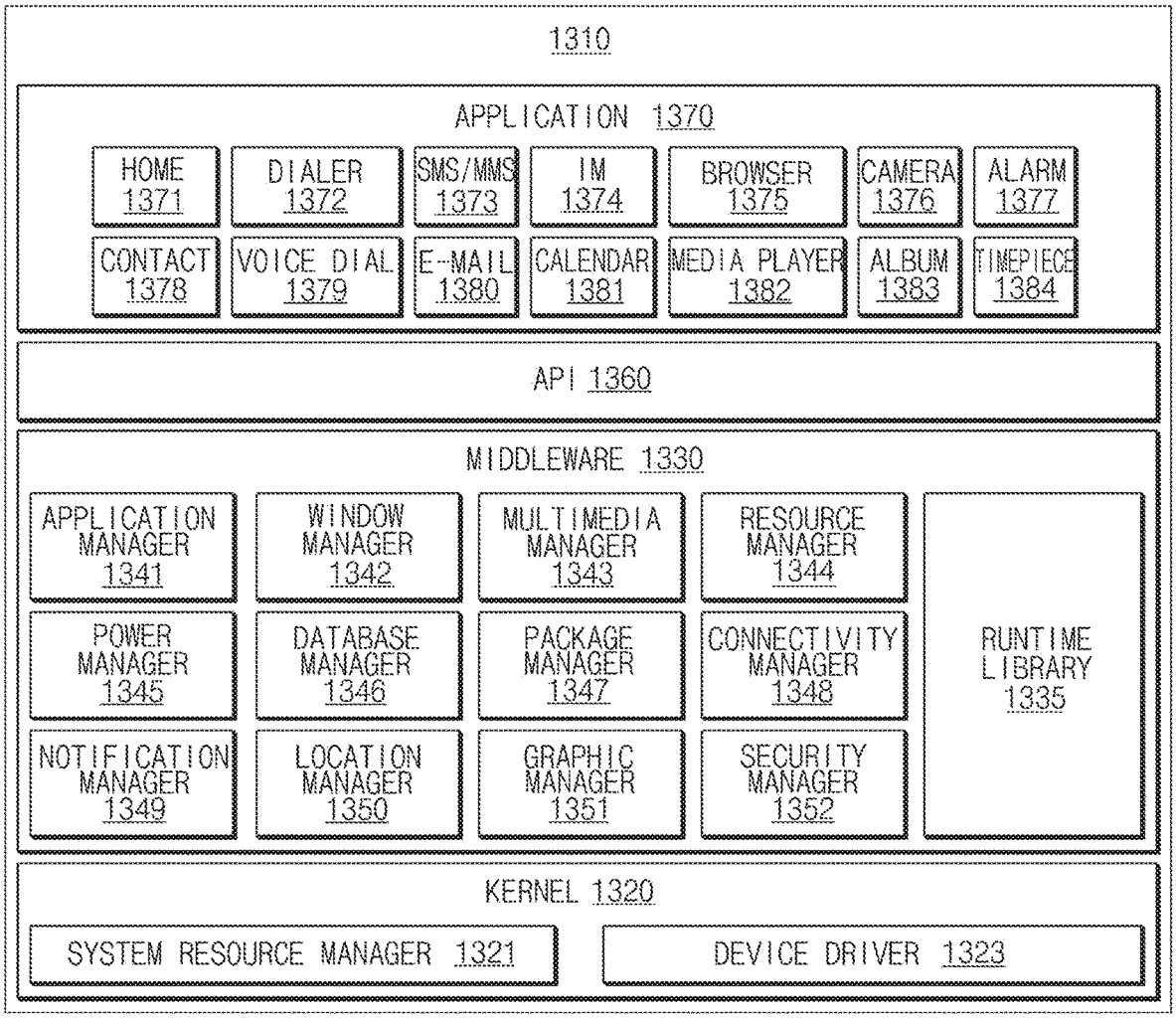
FIG. 13 illustrates a block diagram of a program module according to various embodiments of the disclosure.

FIG. 13 illustrates a block diagram of a program module, according to various embodiments of the disclosure.

Referring to FIG. 13, a program module 1310 (e.g., the program 1140) may include an OS to control resources associated with an electronic device (e.g., the electronic device 1101), and/or diverse applications (e.g., the application program 1147) driven on the OS. The OS may be, for example, Android™, iOS™, Windows™ Symbian™, or Tizen™.

The program module 1310 may include a kernel 1320, a middleware 1330, an API 1360, and/or an application 1370. At least a portion of the program module 1310 may be preloaded on an electronic device or may be downloadable from an external electronic device (e.g., the first electronic device 1102, the second electronic device 1104, the server 1106, or the like).

The kernel 1320 (e.g., the kernel 1141) may include, for example, a system resource manager 1321 or a device driver 1323. The system resource manager 1321 may perform control, allocation, or retrieval of system resources. According to an embodiment, the system resource manager 1321 may include a process managing unit, a memory managing unit, or a file system managing unit. The device driver 1323 may include, for example, a display driver, a camera driver, a BT driver, a shared memory driver, a USB driver, a keypad driver, a Wi-Fi driver, an audio driver, or an inter-process communication (IPC) driver.

The middleware 1330 may provide, for example, a function that the application 1370 needs in common, or may provide diverse functions to the application 1370 through the API 1360 to allow the application 1370 to efficiently use limited system resources of the electronic device. According to an embodiment, the middleware 1330 (e.g., the middleware 1143) may include at least one of a runtime library 1335, an application manager 1341, a window manager 1342, a multimedia manager 1343, a resource manager 1344, a power manager 1345, a database manager 1346, a package manager 1347, a connectivity manager 1348, a notification manager 1349, a location manager 1350, a graphic manager 1351, or a security manager 1352.

The runtime library 1335 may include, for example, a library module that is used by a compiler to add a new function through a programming language while the application 1370 is being executed. The runtime library 1335 may perform input/output management, memory management, or capacities about arithmetic functions.

The application manager 1341 may manage, for example, a life cycle of at least one application of the application 1370. The window manager 1342 may manage a graphic user interface (GUI) resource that is used in a screen. The multimedia manager 1343 may identify a format necessary for playing diverse media files, and may perform encoding or decoding of media files by using a codec suitable for the format. The resource manager 1344 may manage resources such as a storage space, memory, or source code of at least one application of the application 1370.

The power manager 1345 may operate, for example, with a basic input/output system (BIOS) to manage a battery or power, and may provide power information for an operation of an electronic device. The database manager 1346 may generate, search for, or modify database that is to be used in at least one application of the application 1370. The package manager 1347 may install or update an application that is distributed in the form of package file.

The connectivity manager 1348 may manage, for example, wireless connection such as Wi-Fi or BT. The notification manager 1349 may display or notify an event such as arrival message, appointment, or proximity notification in a mode that does not disturb a user. The location manager 1350 may manage location information about an electronic device. The graphic manager 1351 may manage a graphic effect that is provided to a user, or manage a user interface relevant thereto. The security manager 1352 may provide a general security function necessary for system security, user authentication, or the like. According to an embodiment, in the case where an electronic device (e.g., the electronic device 1101) includes a telephony function, the middleware 1330 may further include a telephony manager for managing a voice or video call function of the electronic device.

The middleware 1330 may include a middleware module that combines diverse functions of the above-described elements. The middleware 1330 may provide a module specialized to each OS kind to provide differentiated functions. Additionally, the middleware 1330 may dynamically remove a part of the preexisting elements or may add new elements thereto.

The API 1360 (e.g., the API 1145) may be, for example, a set of programming functions and may be provided with a configuration that is variable depending on an OS. For example, in the case where an OS is Android™ or iOS™, it may provide one API set per platform. In the case where an OS is Tizen™, it may provide two or more API sets per platform.

The application 1370 (e.g., the application program 1147) may include, for example, one or more applications capable of providing functions for a home 1371, a dialer 1372, a short message service (SMS)/multimedia message service (MMS) 1373, an instant message (IM) 1374, a browser 1375, a camera 1376, an alarm 1377, a contact 1378, a voice dial 1379, an e-mail 1380, a calendar 1381, a media player 1382, an album 1383, or a timepiece 1384 or for offering health care (e.g., measuring an exercise quantity, blood sugar, or the like) or environment information (e.g., information of barometric pressure, humidity, temperature, or the like).

According to an embodiment, the application 1370 may include an application (hereinafter referred to as "information exchanging application" for descriptive convenience) to support information exchange between an electronic device (e.g., the electronic device 1101) and an external electronic device (e.g., the first electronic device 1102 or the second electronic device 1104). The information exchanging application may include, for example, a notification relay application for transmitting specific information to an external electronic device, or a device management application for managing the external electronic device.

For example, the notification relay application may include a function of transmitting notification information, which arise from other applications (e.g., applications for SMS/MMS, e-mail, health care, or environmental information), to an external electronic device. Additionally, the information exchanging application may receive, for example, notification information from an external electronic device and provide the notification information to a user.

The device management application may manage (e.g., install, delete, or update), for example, at least one function (e.g., turn-on/turn-off of an external electronic device itself (or a part of elements) or adjustment of brightness (or resolution) of a display) of the external electronic device which communicates with the electronic device, an application running in the external electronic device, or a service (e.g., a call service, a message service, or the like) provided from the external electronic device.

According to an embodiment, the application 1370 may include an application (e.g., a health care application of a mobile medical device) that is assigned in accordance with an attribute of an external electronic device. According to an embodiment, the application 1370 may include an application that is received from an external electronic device (e.g., the first electronic device 1102, the second electronic device 1104, or the server 1106). According to an embodiment, the application 1370 may include a preloaded application or a third party application that is downloadable from a server. The names of elements of the program module 1310 according to the embodiment may be modifiable depending on kinds of OSs.

According to various embodiments, at least a portion of the program module 1310 may be implemented by software, firmware, hardware, or a combination of two or more thereof. At least a portion of the program module 1310 may be implemented (e.g., executed), for example, by the processor (e.g., the one or more processors 1210). At least a portion of the program module 1310 may include, for example, modules, programs, routines, sets of instructions, processes, or the like for performing one or more functions.

An electronic device (e.g., the electronic device 900 of FIG. 9) according to an embodiment may include a housing including a first plate (e.g., the first plate 910 of FIG. 9), a second plate (e.g., the second plate 920 of FIG. 9) facing away from the first plate, a side member surrounding a space between the first plate and the second plate, wherein the second plate is formed of an electrically conductive material, wherein the side member is formed of an electrically conductive material and includes a first side (e.g., the first side 930 of FIG. 9) extending in a first direction and having a first length, a second side (e.g., the second side 932 of FIG. 9) extending in a second direction perpendicular to the first direction and having a second length shorter than the first length, a third side (e.g., the third side 934 of FIG. 9) extending in parallel to the first side and having the first length, and a fourth side (e.g., the fourth side 936 of FIG. 9) extending in parallel to the second side and having the second length, and wherein the side member further includes an elongated slit extending from a first point in the first side to a second point in the third side along a portion of the first side, the second side, and a portion of the third side, and a non-conductive material filling the slit, a touchscreen display exposed through at least a portion of the first plate, a wireless communication circuit positioned inside the housing and electrically coupled to a third point (e.g., the third point 928 of FIG. 9) and a fourth point (e.g., the fourth point 922 of FIG. 9) in the second plate, wherein the third point is closer to the second side than the fourth point is to the second side, a ground plane positioned in the housing in parallel to the second plate, and electrically coupled to at least one fifth point (e.g., the at least one fifth point 924 of FIG. 9) and a sixth point (e.g., the sixth point 926 of FIG. 9) in the second plate, wherein the sixth point is closer to the second side than the fourth point and the at least one fifth point are to the second side, wherein the third point is closer to the second side than the sixth point is to the second side, and wherein the fourth point is closer to the second side than the at least one fifth point is to the second side, and at least one processor positioned inside the housing and electrically connected to the display and the communication circuit.

The electronic device according to an embodiment may further include a switching element positioned inside the housing and electrically connected to a seventh point (e.g., the seventh point 1050 of FIG. 10) near the fourth side.

The fourth point of the electronic device according to an embodiment may be in a region between the third point and the at least one fifth point when viewed from above the second plate.

The sixth point of the electronic device according to an embodiment may be outside the region.

The electronic device according to an embodiment may further include a switching element positioned inside the housing and electrically connected to an eighth point (e.g., the eighth point 1040 of FIG. 10) that is closer to the second side than the third point is to the second side.

The fourth point of the electronic device according to an embodiment may be in a region between the eighth point and the at least one fifth point when viewed from above the second plate.

The sixth point of the electronic device according to an embodiment may be outside the region.

The communication circuit of the electronic device according to an embodiment may be configured to provide a wireless signal in a frequency range of 1.5 GHz to 2.4 GHz.

An electronic device (e.g., the electronic device 100 of FIGS. 1 A and 1B) according to an embodiment may include a housing including a first plate (e.g., the first plate 110 of FIGS. 1 A and 1B), a second plate (e.g., the second plate 120 of FIG. 1) facing away from the first plate and including an electrically conductive material, and a side member (e.g., 130, 132, 134, and 136 of FIGS. 1 A and 1B) surrounding a space between the first plate and the second plate, a display exposed through at least a portion of the first plate, a wireless communication circuit configured to feed a first feeding point (e.g., the first feeding point 122 of FIGS. 1 A and 1B) in the second plate, a ground plane electrically coupled to at least one first ground point (e.g., the at least one first ground point 124 of FIGS. 1 A and 1B) in a first region of the second plate and a second ground point (e.g., the at least one second ground point 126 of FIGS. 1 A and 1B) in a second region of the second plate, and at least one processor electrically connected to the display and the wireless communication circuit. The wireless communication circuit, the ground plane, and the processor may be positioned inside the housing. The side member may be formed of an electrically conductive material, and may include a first side (e.g., the first side 130 of FIGS. 1 A and 1B) extending in a first direction and having a first length, a second side (e.g., the second side 132 of FIGS. 1 A and 1B) extending in a second direction perpendicular to the first direction and having a second length shorter than the first length, a third side (e.g., the third side 134 of FIGS. 1 A and 1B) extending in parallel to the first side and having the first length, and a fourth side (e.g., the fourth side 136 of FIGS. 1 A and 1B) extending in parallel to the second side and having the second length. The first feeding point may be in a region between the second side and the at least one first ground point, the first feeding point may be closer to the second side than the at least one first ground point is to the second side, and the second ground point may be closer in distance to the second side than the first feeding point and the at least one first ground point is to the second side, and may be outside the region.

The wireless communication circuit of the electronic device according to an embodiment may be configured to feed a second feeding point (e.g., the second feeding point 316 of FIG. 3) in the second plate, and the first feeding point may be in a region between the at least one first ground point and the second feeding point.

The electronic device according to an embodiment may further include a switch that is positioned inside the housing and is selectively connected with the first feeding point and the second feeding point.

The at least one first ground point of the electronic device according to an embodiment may be at a point that is spaced apart from the second side by a distance of $\lambda/4$, and the first feeding point may be at a point that is spaced apart from the at least one first ground point by a distance of $\lambda/10$.

The ground plane of the electronic device according to an embodiment may be electrically coupled to a third ground point (e.g., the third ground point 718 of FIG. 7) in the second plate, and the third ground point may be closer in distance to the second side than the first feeding point and the at least one first ground point is to the second side, and is inside the region.

The electronic device according to an embodiment may further include a switch that is positioned inside the housing and is selectively connected with the second ground point or the third ground point.

The ground plane of the electronic device according to an embodiment may be electrically coupled to a fourth ground point in the second plate, and the fourth ground point may be near the second ground point.

The electronic device according to an embodiment may further include a first antenna including a portion of the side member extending from a point in the first side to a point in the third side along a portion of the first side, the second side, and a portion of the third side, and a portion of the second plate from the second side to a line that extends from the point in the first side to the point in the third side along the second plate. The first feeding point, the second ground point, and the fourth ground point may be farther in distance from the second side than the extending line is from the second side.

The electronic device according to an embodiment may further include a slit (e.g., the slit 530 of FIGS. 5A and 5B) extending in parallel to the extending line along the second plate from the point in the first side to the point in the third side, and a non-conductive material filling the slit. The slit may be between the first antenna, and the first feeding point and the second ground point.

The wireless communication circuit of the electronic device according to an embodiment may be configured to feed a third feeding point that is in a region of the first plate except for the display.

The electronic device according to an embodiment may further include a conductive member electrically coupled to the third feeding point.

Figure 1B:
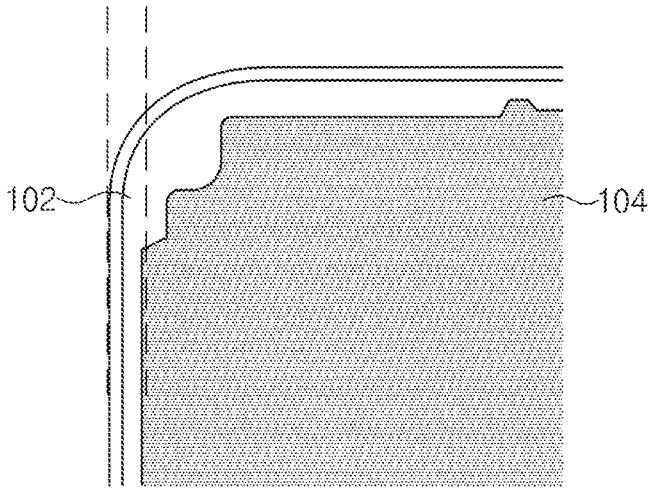

The electronic device according to an embodiment may further include a space between the side member and the display (e.g., the display 114 of FIG. 1 A).

The term "module" used in this disclosure may represent, for example, a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific IC (ASIC) chip, a field-programmable gate array (FPGA), and a programmable-logic device for performing some operations, which are known or will be developed.

At least a part of an apparatus (e.g., modules or functions thereof) or a method (e.g., operations) according to various embodiments may be, for example, implemented by instructions stored in a computer-readable storage media in the form of a program module. The instruction, when executed by a processor (e.g., the processor 1120), may cause the one or more processors to perform a function corresponding to the instruction. The computer-readable storage media, for example, may be the memory 1130.

A computer-readable recording medium may include a hard disk, a floppy disk, a magnetic media (e.g., a magnetic tape), an optical media (e.g., a compact disc read only memory (CD-ROM) and a DVD, a magneto-optical media (e.g., a floptical disk)), and hardware devices (e.g., a read only memory (ROM), a random access memory (RAM), or a flash memory). Also, the one or more instructions may contain a code made by a compiler or a code executable by an interpreter. The above hardware unit may be configured to operate via one or more software modules for performing an operation according to various embodiments, and vice versa.

A module or a program module according to various embodiments may include at least one of the above elements, or a part of the above elements may be omitted, or additional other elements may be further included. Operations performed by a module, a program module, or other elements according to various embodiments may be executed sequentially, in parallel, repeatedly, or in a heuristic method. In addition, some operations may be executed in different sequences or may be omitted. Alternatively, other operations may be added.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a housing comprising:

a first plate, a second plate facing away from the first plate, and a side member surrounding a space between the first plate and the second plate, the second plate being formed of an electrically conductive material, the side member being formed of an electrically conductive material and including a first side extending in a first direction and having a first length, a second side extending in a second direction perpendicular to the first direction and having a second length shorter than the first length, a third side extending in parallel to the first side and having the first length, and a fourth side extending in parallel to the second side and having the second length, the side member further including an elongated slit extending from a first point in the first side to a second point in the third side along a portion of the first side, the second side, and a portion of the third side, and a non-conductive material filling the slit;

a touchscreen display exposed through at least a portion of the first plate;

a wireless communication circuit positioned inside the housing and electrically coupled to a third point and a fourth point in the second plate, the third point being closer to the second side than the fourth point is to the second side;

a ground plane positioned in the housing in parallel to the second plate, and electrically coupled to at least one fifth point and a sixth point in the second plate, the sixth point being closer to the second side than the fourth point and the at least one fifth point are to the second side, the third point being closer to the second side than the sixth point is to the second side, and the fourth point being closer to the second side than the at least one fifth point is to the second side; and at least one processor positioned inside the housing and electrically connected to the display and the communication circuit.

2. The electronic device of claim 1, further comprising a switching element positioned inside the housing and electrically connected to a seventh point near the fourth side.

3. The electronic device of claim 1, wherein the fourth point is in a region between the third point and the at least one fifth point when viewed from above the second plate.

4. The electronic device of claim 3, wherein the sixth point is outside the region.

5. The electronic device of claim 1, further comprising a switching element positioned inside the housing and electrically connected to an eighth point that is closer to the second side than the third point is to the second side.

6. The electronic device of claim 5, wherein the fourth point is in a region between the eighth point and the at least one fifth point when viewed from above the second plate.

7. The electronic device of claim 6, wherein the sixth point is outside the region.

8. The electronic device of claim 1, wherein the communication circuit is configured to provide a wireless signal in a frequency range of 1.5 GHz to 2.4 GHz.

9. An electronic device comprising:

a housing including a first plate, a second plate facing away from the first plate and including an electrically conductive material, and a side member surrounding a space between the first plate and the second plate;

a display exposed through at least a portion of the first plate;

a wireless communication circuit configured to feed a first feeding point in the second plate;

a ground plane electrically coupled to at least one first ground point in a first region of the second plate and a second ground point in a second region of the second plate; and at least one processor electrically connected to the display and the wireless communication circuit, wherein the wireless communication circuit, the ground plane, and the at least one processor are positioned inside the housing, wherein the side member is formed of an electrically conductive material, wherein the side member includes a first side extending in a first direction and having a first length, a second side extending in a second direction perpendicular to the first direction and having a second length shorter than the first length, a third side extending in parallel to the first side and having the first length, and a fourth side extending in parallel to the second side and having the second length, wherein the first feeding point is in a region between the second side and the at least one first ground point, wherein the first feeding point is closer to the second side than the at least one first ground point is to the second side, and wherein the second ground point is closer in distance to the second side than the first feeding point and the at least one first ground point is to the second side, and is outside the region.

10. The electronic device of claim 9, wherein the wireless communication circuit is further configured to feed a second feeding point in the second plate, and wherein the first feeding point is in a region between the at least one first ground point and the second feeding point.

11. The electronic device of claim 10, further comprising a switch positioned inside the housing and configured to be selectively connected with the first feeding point or the second feeding point.

12. The electronic device of claim 9, wherein the at least one first ground point is at a point that is spaced apart from the second side by a distance of $\lambda/4$, and wherein the first feeding point is at a point that is spaced apart from the at least one first ground point by a distance of $\lambda/10$.

13. The electronic device of claim 9, wherein the ground plane is electrically coupled to a third ground point in the second plate, and wherein the third ground point is closer in distance to the second side than the first feeding point and the at least one first ground point is to the second side, and is inside the region.

14. The electronic device of claim 13, further comprising a switch positioned inside the housing and configured to be selectively connected with the second ground point or the third ground point.

15. The electronic device of claim 9, wherein the ground plane is electrically coupled to a fourth ground point in the second plate, and wherein the fourth ground point is near the second ground point.

16. The electronic device of claim 15, further comprising:

a first antenna including a portion of the side member extending from a point in the first side to a point in the third side along a portion of the first side, the second side, and a portion of the third side, and a portion of the second plate from the second side to a line that extends from the point in the first side to the point in the third side along the second plate, wherein the first feeding point, the second ground point, and the fourth ground point are farther in distance from the second side than the extending line is from the second side.

17. The electronic device of claim 16, further comprising:

a slit extending in parallel to the extending line along the second plate from the point in the first side to the point in the third side, and a non-conductive material filling the slit, wherein the slit is between the first antenna and the first feeding point and the second ground point.

18. The electronic device of claim 9, wherein the wireless communication circuit is further configured to feed a third feeding point that is in a region of the first plate except for the display.

19. The electronic device of claim 18, further comprising a conductive member electrically coupled to the third feeding point.

20. The electronic device of claim 9, further comprising a space between the side member and the display.

* * * * *